US005984587A

United States Patent [19]

Odle

[11] Patent Number: 5,984,587

[45] Date of Patent: Nov. 16, 1999

[54] GROUND STABILIZATION APPARATUS AND METHOD FOR INSTALLING AN ENLONGATED POST

[76] Inventor: Stanley W. Odle, 2120 Bassett, Sedro Woolley, Wash. 98273

[21] Appl. No.: 08/965,622

[22] Filed: Nov. 6, 1997

[51] Int. Cl.[6] ..... E02D 5/74; E04H 12/20; F16M 13/00

[52] U.S. Cl. ..... 405/244; 40/607; 52/153; 248/545; 248/530; 405/232

[58] Field of Search ..... 405/244, 232, 405/216, 233, 303; 52/170, 153, 155, 514; 248/530, 545, 533, 156, 157, 165; 40/607

[56] References Cited

U.S. PATENT DOCUMENTS

| | | | |
|---|---|---|---|
| 219,618 | 9/1879 | Carley et al. | 405/244 |
| 254,662 | 3/1882 | Kinney | 52/170 X |
| 720,025 | 2/1903 | Harbold . | |
| 819,637 | 5/1906 | Diescher | 52/153 X |
| 897,417 | 9/1908 | Self . | |
| 1,025,823 | 5/1912 | Morrow . | |
| 1,408,332 | 2/1922 | Zimmerman | 52/153 |
| 1,433,621 | 10/1922 | Hutton . | |
| 2,036,047 | 4/1936 | Hill . | |
| 2,596,976 | 5/1952 | Barber | 52/514 X |
| 2,846,852 | 8/1958 | Cappel | 52/170 X |
| 3,115,226 | 12/1963 | Thompson . | |
| 3,342,444 | 9/1967 | Nelson . | |
| 4,048,779 | 9/1977 | Valenziano et al. | 52/514 X |
| 4,079,556 | 3/1978 | Luck et al. | 52/155 X |
| 4,269,010 | 5/1981 | Glass . | |
| 4,271,646 | 6/1981 | Mills . | |
| 4,588,157 | 5/1986 | Mills . | |
| 4,753,411 | 6/1988 | Lechner et al. | 248/545 X |
| 4,910,902 | 3/1990 | Anderson | 248/530 X |
| 5,082,231 | 1/1992 | Knowles . | |
| 5,263,279 | 11/1993 | Delsanne et al. | 248/530 X |

FOREIGN PATENT DOCUMENTS

| | | | |
|---|---|---|---|
| 1434031 | 10/1988 | U.S.S.R. | 52/155 |

*Primary Examiner*—Dennis L. Taylor
*Attorney, Agent, or Firm*—Hughes & Schacht, P.S.; Robert B. Hughes

[57] ABSTRACT

A ground stabilization apparatus and method for using the same in the installation of an elongated post such as a fence post, mailbox post, or sign post. The ground stabilization apparatus has a central ground support collar to which a plurality of radially extending stabilization arms are attached. By changing the position of the stabilization arm when it is inserted into the central ground support collar, a variety of post sizes and shapes can be installed using the apparatus. The ground stabilization apparatus is used to maintain the post in its upright and plumb position over time by distributing the force action on the post to a large area surrounding the post near the surface of the ground. The method of using the ground stabilization apparatus describes installing the device in a shallow channel that surrounds the post hole into which the post is to be placed.

31 Claims, 15 Drawing Sheets

GROUND STABILIZATION APPARATUS AND METHOD FOR INSTALLING AN ENLONGATED POST

BACKGROUND OF THE INVENTION

1. Field of the Invention

This invention relates generally to the field of apparatus for use in the installation of an elongated post in the ground to stabilize the post in an upright position, and more particularly to a ground stabilization apparatus that outwardly distributes forces applied by the post into the substrate in which it is embedded.

2. Background Art

It has long been recognized that an elongated fence post that is simply buried in dirt hole will begin to lean over time. Eventually, the lean becomes extreme enough that the fence has to be replaced because of aesthetic or structural considerations. The solution in the background art has been to hinder the movement of the post by attaching an apparatus to its base end before that end is buried in the dirt. The added surface area of these apparatus provides extra resistance against the dirt surrounding it.

An example of this type of device is found in a 1903 patent granted to Harbold. In this patent, U.S. Pat. No. 720,025 taught attaching two sets of cross members to two sides of the bottom of the fence post before burying it. The post is further braced by a cable that loops around the top of the post and descends outwardly toward the ground where it is held by anchor bars that are also designed to resist pulling from the ground by having a relatively large surface area held by the force of the dirt in which it is buried.

This concept of increasing the surface area of the base of the post in an effort to increase resistance is also found in U.S. Pat. No. 1,025,823 (Morrow). In Morrow, the post is designed to support horizontally mounted plates at a variety of depths along the buried portion of the post. U.S. Pat. No. 897,417 granted to Self adds surface area at variety of depths along the buried portion of telephone poles. This surface area adding apparatus is comprised of an upper cylindrical collar with a flanged base that is attached to the bottom end of a telephone pole. The flange portion of the base is covered with dirt, partially filling the hole, where a second surface area increasing member is attached to the upper collar portion of the base. The end of the telephone pole is secured within the collar flange and the device is then fully buried.

Two other devices to increase the surface area of the base of a rod or post are found in U.S. Pat. No. 1,433,621 (Hutton) and U.S. Pat. No. 4,269,010 (Glass). The device taught in Hutton is comprised of a base plate with four upwardly extending concrete reinforcing fins that converge to a vertical central collar. This central collar holds the base of the rod. This entire anchor assembly is then buried in a hole dug large enough to accommodate the entire apparatus. Another finned device is taught in U.S. Pat. No. 4,269,010 (Glass). This device has a central plate with an opening through which the base of the post is firmly gripped by a plurality of radially spaced, elongated vertical splines. Several of these devices are buried at different depths along the base portion of the post.

While the patents above all take advantage of their extra surface area to act as a resistance against the soil in which they are buried, the problem is that the ability of the soil to counter the resistive force of these devices is severely compromised by the very fact that a great deal of the naturally compacted dirt has to be removed in order to place these devices into the hole. The dirt is then replaced over the resistance members and tamped down. It is probable that it will take months, if not years, for the soil to regain the compaction that it possessed before it was disturbed in order to bury these devices.

One patent that recognized the problem of losing the natural compaction of the dirt when a hole is dug for the post is U.S. Pat. No. 3,115,226 (Thomson). In this patent, Thomson teaches a device that does not require a large hole to be dug. Instead, a collar is driven into the ground where an explosive charge is detonated in its end to form an underground cavern. The post assembly is placed into the collar where a set of spring loaded fins extend once they reach the open cavern. It is even suggested in the Thomson patent, just discussed, to fill the underground cavern with concrete by pouring it through the collar.

Despite the teaching of these patents, the preferred method of fence post installation is the pouring of concrete either around the base of the post, or filling the entire hole, commonly two to three feet deep with a diameter approximately twice that of the post, with cement. Once the post is lowered into the hole, it is temporarily braced in an upright and plumb position using boards nailed to the post on one end and to stakes on the opposite end. Typically, between one and three sixty-pound bags of concrete are mixed and poured into each hole. The concrete is then allowed to dry for two days or more. Once the concrete is set, the temporary bracing is removed and the partitions of the fence are constructed between the posts. A typical one-quarter acre lot requires approximately four hundred and twenty feet of fencing to surround it. This means that about fifty-five posts have to be installed with each requiring between one and three sixty-pound bags of concrete. With between a ton and a half and almost five tons of concrete required to install this relatively short fence, it is not hard to imagine the considerable amount of cost and effort that goes into the digging, concrete mixing, alignment and temporary bracing of the fence posts. And this method is the current state of the art in post installation.

Installation of fence posts in concrete is by its very nature a permanent installation— permanent being until the fence needs to be replaced. To replace the post, one must typically dig out a two to three foot by eight inch concrete plug weighing at least sixty pounds, lift the old post and concrete plug from the hole, and then figuring out how to dispose of it. A new post is then set in the hole, which is now larger than the original installation, which means that an even greater quantity of cement is required to fill it. In some applications, a large quality of concrete is acceptable. For instance, U.S. Pat. No. 2,036,047 (Hill) teaches a design for a footing of a transmission tower that is meant to provide adequate surface area to create a firm anchorage when the backfill material, presumably concrete, is placed over the footing and tamped in place. For most installations, however, concrete is a little too permanent.

In some applications, concrete is not desirable because the installation of the post is only meant to be temporary. A primary example of this is a real estate sign. U.S. Pat. No. 5,082,231 (Knowles) attempts to meet this need where a device for the temporary placement of posts is described. This device includes a ground engaging portion that is comprised of three radially extending fins that taper to an axially aligned center point, much like an arrowhead used for hunting. At the upper junction of the three fins, similar to the where the shaft of an arrow would be placed, is a collar that receives the base of the fence post. The device is installed in the ground by placing a temporary driver cap into the collar and driving the point of the ground-engaging member into the ground using a mallet, probably better described as a sledge hammer. The cap is then removed and the lower portion of the post is secured into the collar.

A very similar concept was described in U.S. Pat. No. 4,271,646 and U.S. Pat. No. 4,588,157, both granted to Mills prior to the Knowles patent. The device described in these earlier patents seems to be an elongated version of the Knowles device. The ground engaging member of this device has a plurality of fins in a cruciform cross-section that taper to a point and an open box section mounted on the upward portion of the ground engaging member for reception of the bottom end of the post. The primary difference between the Mills and Knowles designs seems to be that Mills uses a piece of scrap lumber as an impact plug for driving the ground engaging member into the ground, while the Knowles design using a specially designed plug that can also be used to start a reception hole in the ground and can later be used as a cap when the post is not inserted into the upper collar portion. In both of these devices, the base of the post is secured inside the collar portion of the device. Mills bends tabs into the post, or in the production version currently on the market, uses a clamp at one corner of the collar to tighten the collar around the post.

U.S. Pat. No. 3,342,444 (Nelson) is another variation on the concept of driving a finned ground engaging member into the ground and then inserting the base of the post into an extended collar with three radially extending fins welded at equal distances around its circumference. Each of these three fins has a second fin mounted perpendicularly to the first at its upper end. This forms a space between the first and second fins that is roughly triangularly shaped and that is intended to act as a pincer that will grab roots and the like as it is driven into the ground.

SUMMARY OF THE INVENTION

Unlike the patents described above, the present invention is based on the premise that it is the surrounding soil, not the post, that is the key to stabilization. Other devices, as well as cement, add surface area to the post itself to increase resistance to movement, while this invention centers its efforts in stabilizing the surrounding soil to restrict movement. This is accomplished in a manner that is non-intrusive to the post, realizes maximum mathematical advantage, and minimizes disturbance of compacted soil surrounding the post hole.

If the post is not assisted in some way in maintaining its position, forces such as contact with animals, wind or from other sources tend to rotate the top of the fence post about a fulcrum point formed at a lower location in the ground. This is commonly seen with fences that sag over time or a mailbox that tips sideways.

The tilt of the fence post is directly related to the distortion of the hole in the dirt in which the fence post is buried. When this hole is first dug, its edges are usually uniform, plumb and square. That same hole over time become more and more "V" shaped as the forces applied to the post cause the post to compact the surrounding dirt in the direction of the force. To construct an average six-foot high fence, usually an eight-foot fence post is buried two feet into the ground. The fence post is initially held upright by the force applied by the dirt surrounding the post. However, the post begins to lean over time as the less compacted earth near the surface of the ground surrounding the post begins to compact when exterior forces are applied to the post. As the dirt gets deeper around the base of the post it is more resistant to being compacted. Thus, the moment to resist the tipping of the post is applied at a first location very near the bottom of the post and a second location well below the ground surface, but somewhat above the first location.

The present invention does not become an enlargement (or part of the existing post). Rather, it engages the post near the surface of the ground where it acts to distribute the forces applied to the post out to a much larger surrounding area of earth.

In the method of the present invention, first the post hole is dug or otherwise provided to a desired depth dimension, and the lower end portion of the post is inserted into the post hole to position the post in an upstanding position.

There is provided the stabilizing apparatus of the present invention. This comprises a central collar means having a center opening with a width dimension as least as great as a width dimension of the post. There is a plurality of stabilizing arms positioned at angularly spaced locations around the collar means. Each of the arms has a radially inward end portion connecting to the collar means and a radially outer portion extending radially outwardly from the collar means. Each of the arms has at the outer portion stabilizing wall means having a substantial alignment component transverse to a radial axis of its related arm.

Channels are excavated in the upper portion of the ground strata surrounding the post hole in a pattern corresponding to the stabilizing apparatus. The stabilizing apparatus is placed around the post with the collar means surrounding the post and the arms extending radially therefrom in an operating position, in a manner that radially inward portions of the apparatus are in contact with, or closely adjacent to, the post, with the arms being positioned in the surrounding earth strata. Then the channels are filled with a fill material to embed the apparatus in an upper portion of the ground strata.

In the preferred form, the apparatus is arranged, relative to the post, to permit at least limited rotational movement of the post relative to the apparatus. Thus, if there is some tilting of the post, the resistant to such tilting provided by the apparatus is a substantially lateral force component without having significant bending moments transmitted into the apparatus.

In the preferred form, the apparatus comprises releasable connecting means by which the arms are releasably connected to the collar means. The releasable connecting means is desirably arranged so as to be adjustably connected to the related arms. Thus, the arms can be positioned at different locations to accommodate posts having different width dimensions and shapes. In a preferred form, the releasable connecting means comprises tongue and groove connecting means having a plurality of linearly spaced positions. Also, in a preferred form, the arms and the collar are arranged with complimentary graduated marking means, which indicate proper positioning of the arms for posts of various widths.

In another embodiment, the arms are fixedly attached to the collar means. Also in a further modified and further embodiment, there is provided an adapter means which can be positioned around the posts and with the collar means to provide a bearing surface on the insert it is in contact with, or closely adjacent to, the post, so as to transmit lateral forces through the adapter to the apparatus.

Desirably, the channels are excavated to a depth no greater than about one half foot, so that the bottom portion of the arms and the stabilizing means have an average depth of no greater than about one half a foot below the ground surface. Within the broader range of the present invention, the apparatus could be positioned at an average depth below the ground surface of between about two inches to eight inches, and desirably a depth of three inches to six inches below the ground surface.

Desirably the stabilizing wall means on each arm is positioned at a distance from the post greater than one half foot, and more desirably at least as great as about three quarters of a foot from the post. Also, additional stabilizing wall means can be provided at various radial locations along the arms.

The present invention also comprises the combination of the post, inserted in the ground surface, with the stabilizing apparatus positioned around the post in the ground strata. This is accomplished substantially as described above.

Further, the present invention comprises the stabilizing apparatus of the present invention as described above.

Other features of the present invention will become apparent from the following detailed description.

Figure 1:
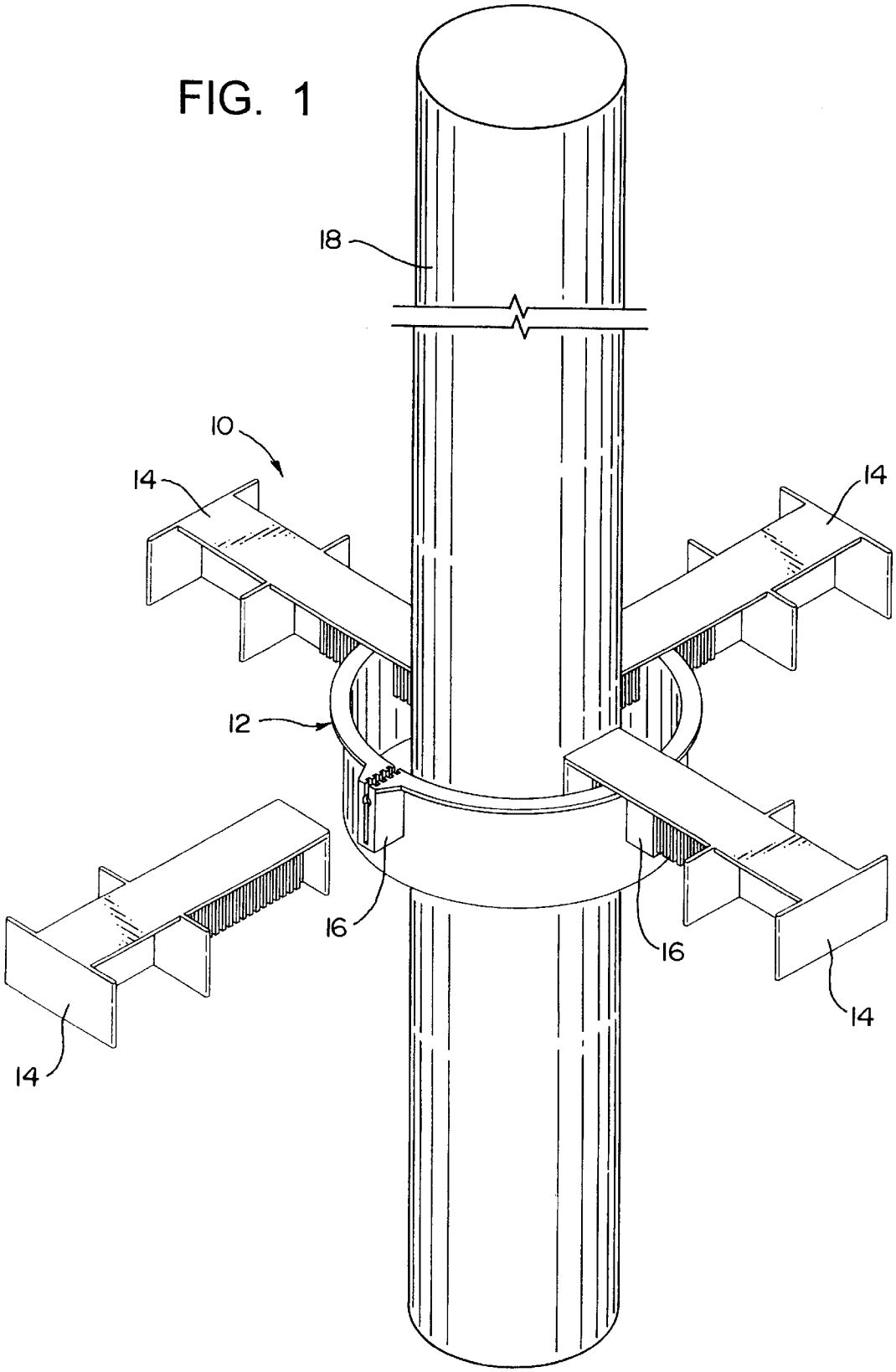
FIG. 1 is a side elevational view showing a preferred embodiment of the present invention.

Unless otherwise noted, if the same reference numeral is used in a one or more of the Figures, that reference character refers to items that are the same or equivalent to that shown in the other Figures. A letter suffix appended to a reference numeral is used to indicate the item as used in a specific embodiment.

DESCRIPTION OF THE PREFERRED EMBODIMENTS

Figure 6:
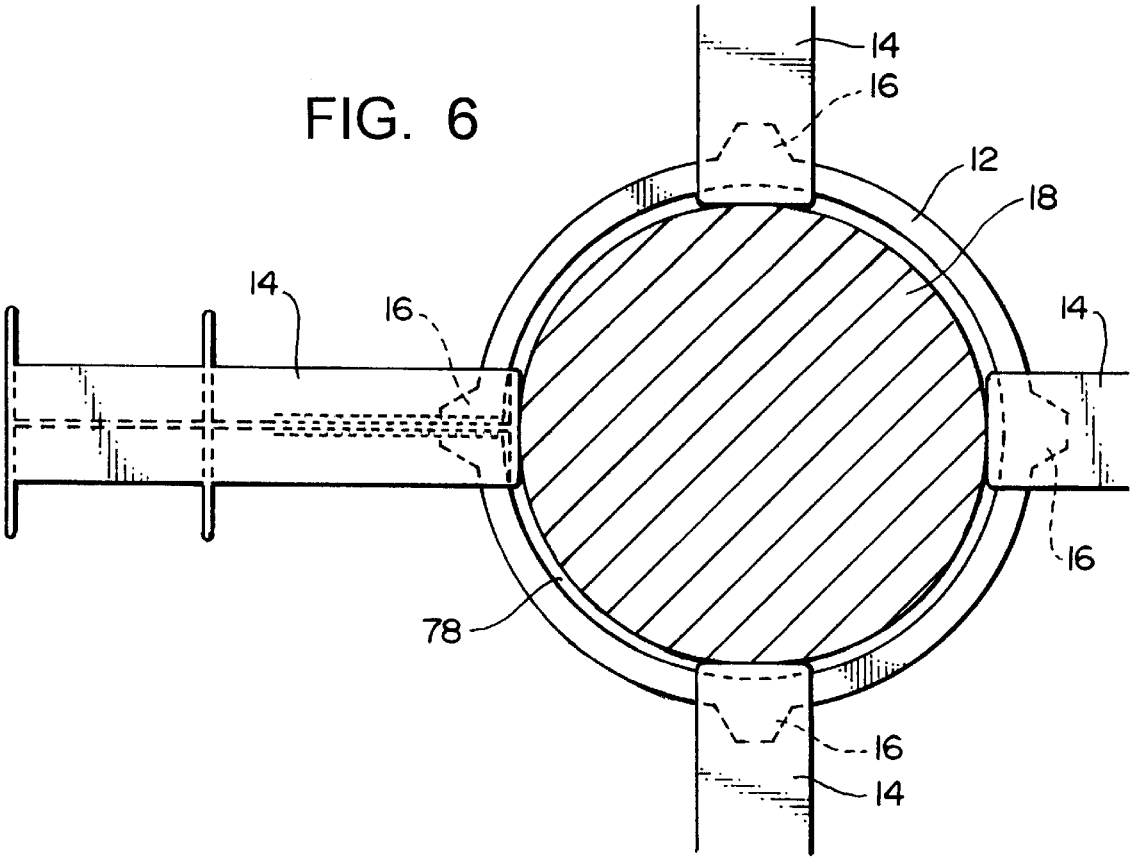
FIG. 6 is a plan view taken from the top of the present invention and showing the ground stabilization apparatus configured to accept an elongated post with a round cross section.
Figure 7:
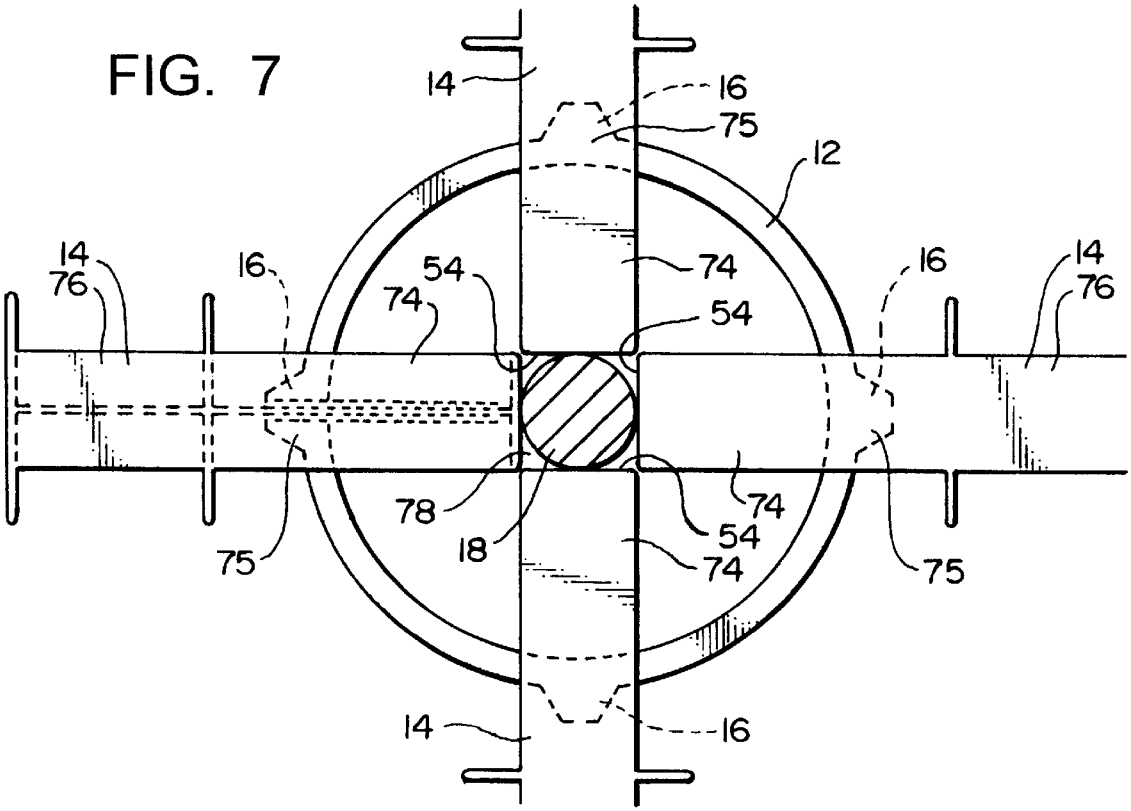
FIG. 7 is a plan view taken from the top of the present invention and showing how the ground stabilization apparatus can be configured to accept elongated post with different size cross sections.
Figure 8:
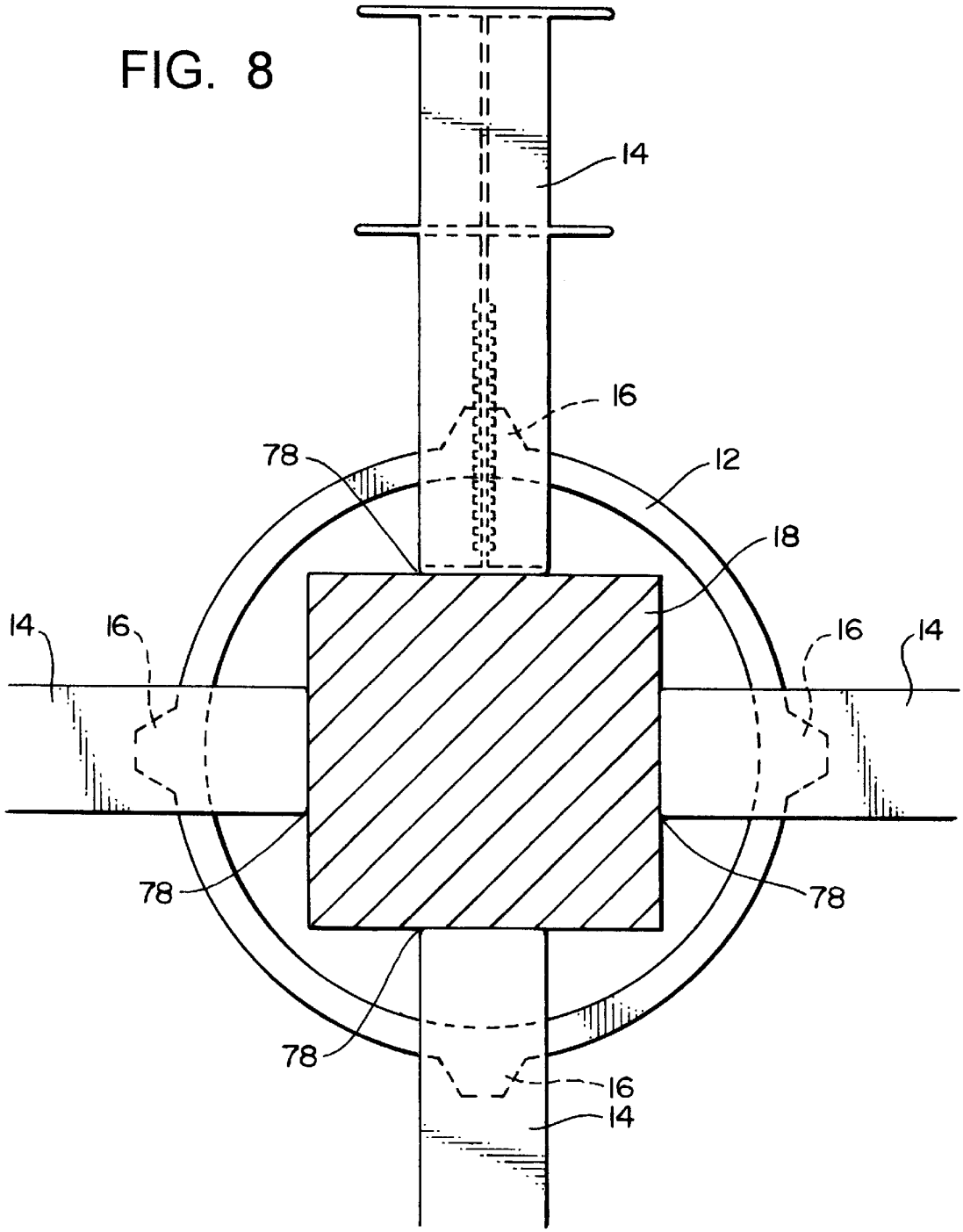
FIG. 8 is a plan view from the top showing the present invention configured to support a post with a different shape cross section such as a square or other polygon.
Figure 9:
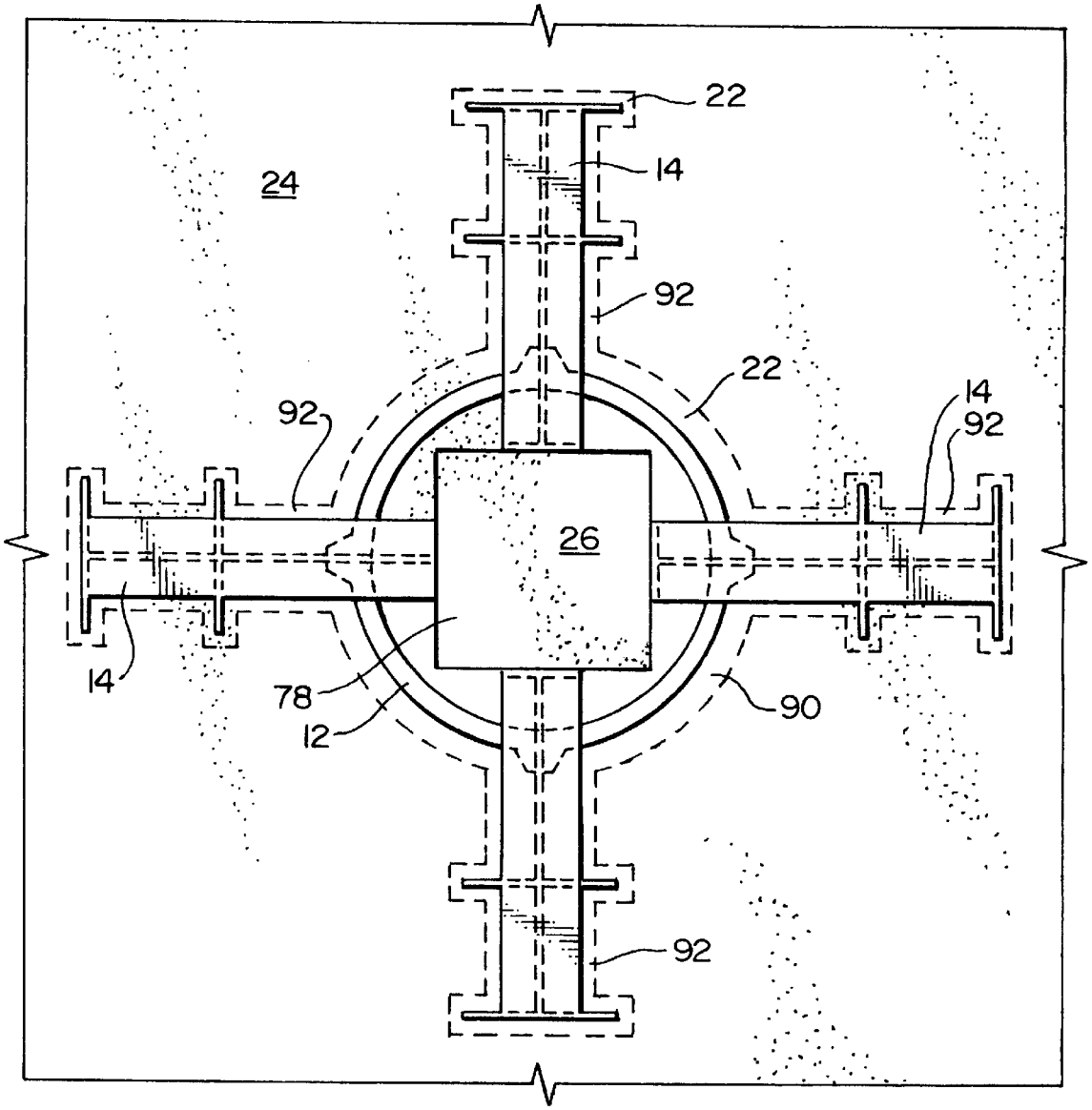
FIG. 9 is a plan view of the ground stabilization assembly as viewed from above when installed with an elongated post into a substrate.
Figure 10:
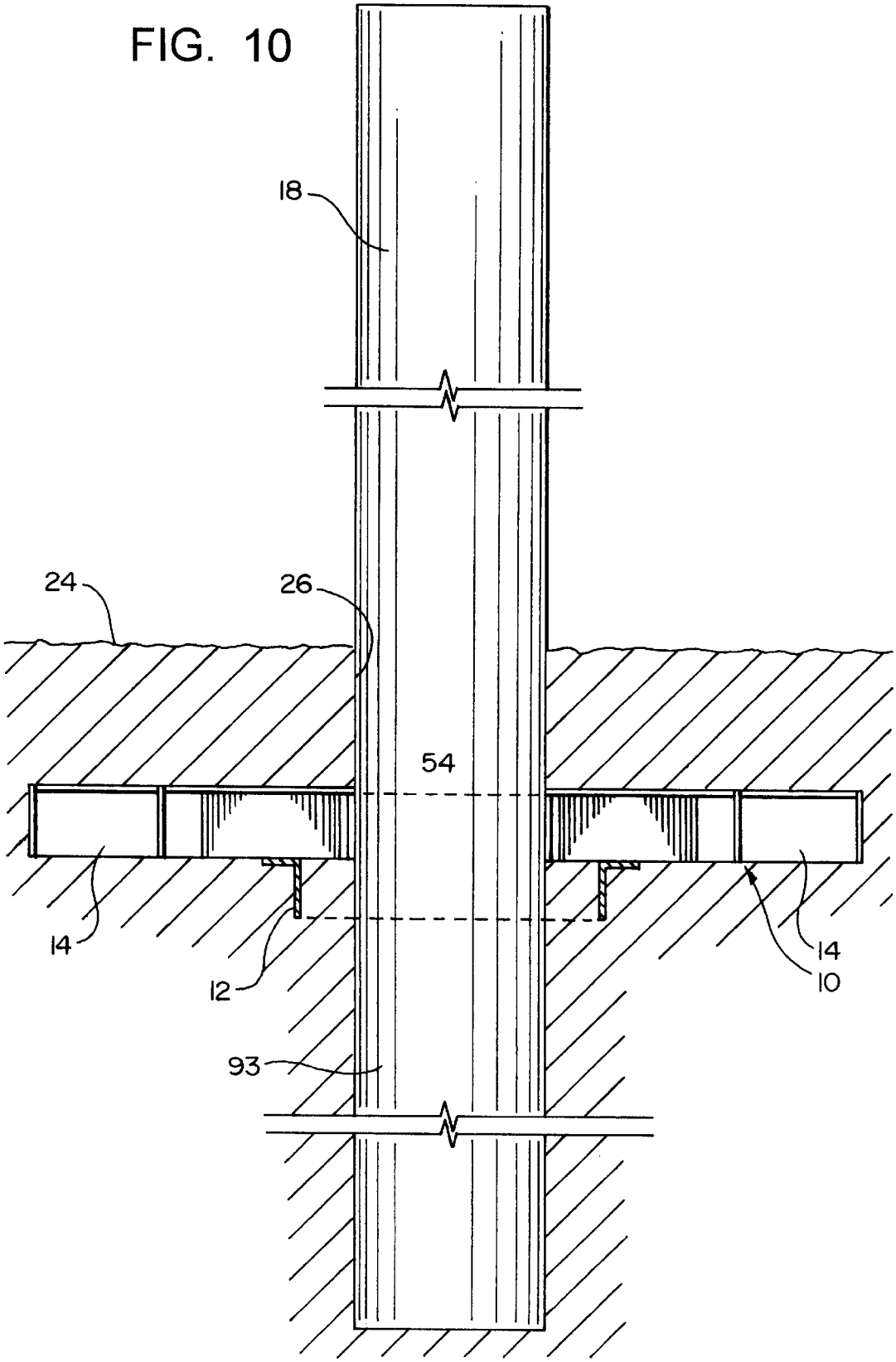
FIG. 10 is a side elevational view of the present invention when installed with a post in the substrate.

The preferred embodiment of the ground stabilization apparatus 10 is shown in the partially exploded view of FIG. 1 and is comprised of a central ground support collar 12 and a plurality of radially extending stabilization arms 14. To use the ground stabilization apparatus 10, the stabilization arms 14 interlock with a corresponding gusset 16 on the ground support collar 12, as is shown in FIGS. 6—8. It is possible to interlock each stabilization arm 14 with the central ground support collar 12 in one of a plurality of positions that are predetermined to accommodate different post 18 sizes. As is shown in FIGS. 9–10, the ground stabilization apparatus 10 is loosely configured and placed over the upright post 18 that has been inserted into the post hole 26 and tamped to a depth two to six inches below ground level. The apparatus 10 is lowered into a shallow channel 22 that surrounds the post hole 26 and configured to fit the post 18. The channel 22 and post hole 26 are then filled with soil and tamped to complete the installation.

Figure 2:
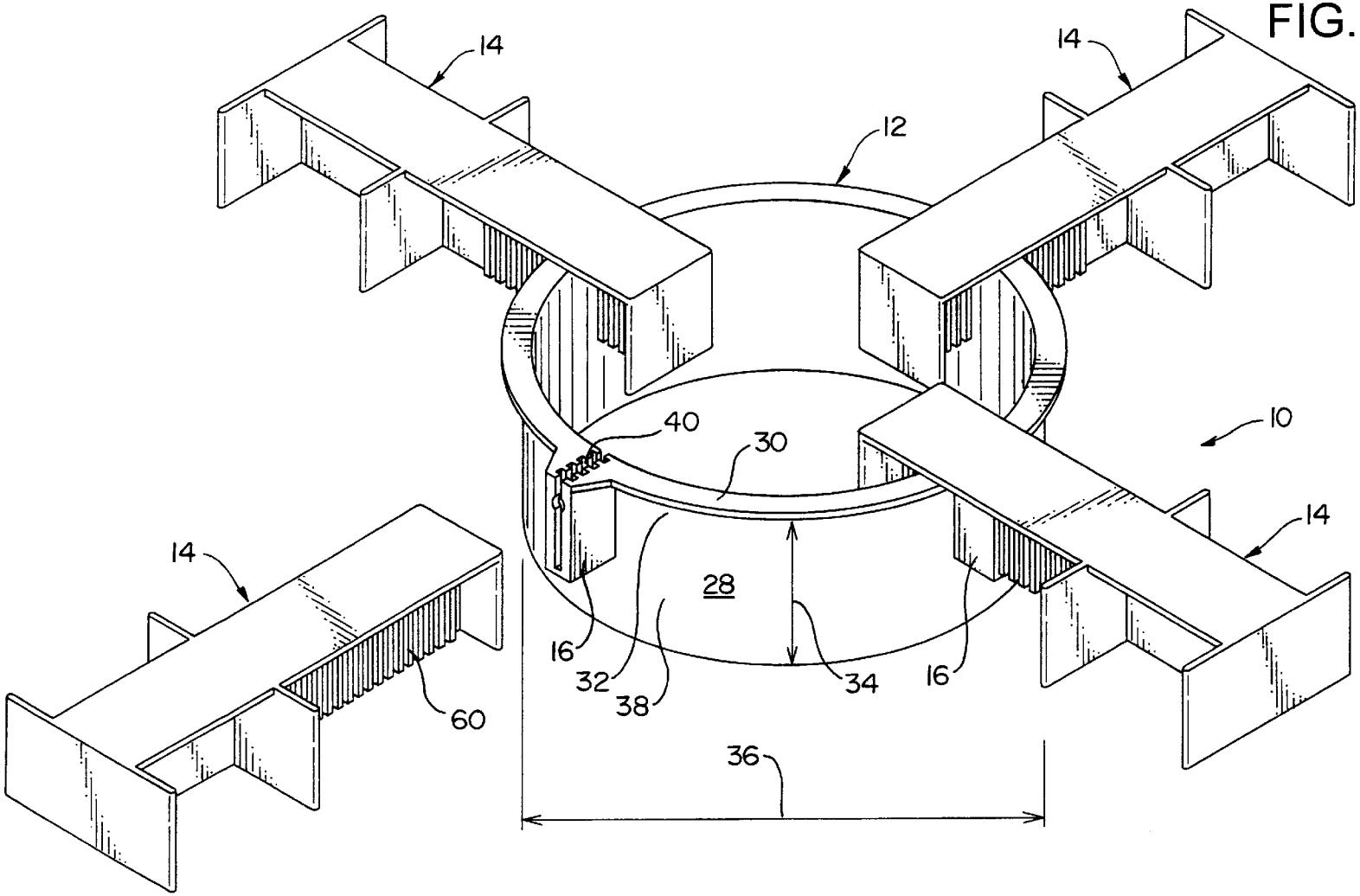
FIG. 2 is a partially exploded isometric view of the present invention.

Referring to FIG. 2, the central ground support collar 12 is comprised of a cylindrical wall 28 with a horizontal perimeter flange or a cap wall 30 perpendicularly attached to its top end 32. The cylindrical has a height 34 that is approximately one-third of its diameter 36. Four radially extending gussets 16 are formed at ninety degree intervals around the perimeter of central ground support collar 12 for interfit with the stabilization arms 14. Each gusset 16 projects radially outwardly with a truncated triangular cross section from the central ground support collar 12 and descends from the cap wall 30 along an exterior surface 38 of the cylindrical wall 28 for approximately two-thirds of it's height 34. Defined within the gusset 16 is the collar 12 portion of an interlock means 40 which receives the stabilization arm 14 portion of the interlock means 60 when the stabilization apparatus 10 is assembled.

In the preferred embodiment, the central ground support collar 12 has a diameter of approximately 9.69 inches and a collar 12 wall height of about 3.5 inches. A ground stabilization apparatus 10 with these dimensions can accommodate a post 18 having a width of from two to eight inches. The central ground support collar 12 and/or the stabilization arms 14 can be scaled upwardly or downwardly to accommodate all post sizes and shapes between two and eight inches in diameter, depending on the application. The circular shape of the central ground support collar 12 was chosen because of its ability to evenly distribute the forces to the remainder of the ground stabilization apparatus 10. This circular shape is not critical to the design, and another regular polygon could be used such as a square, a hexagon, or an octagon.

Figure 3:
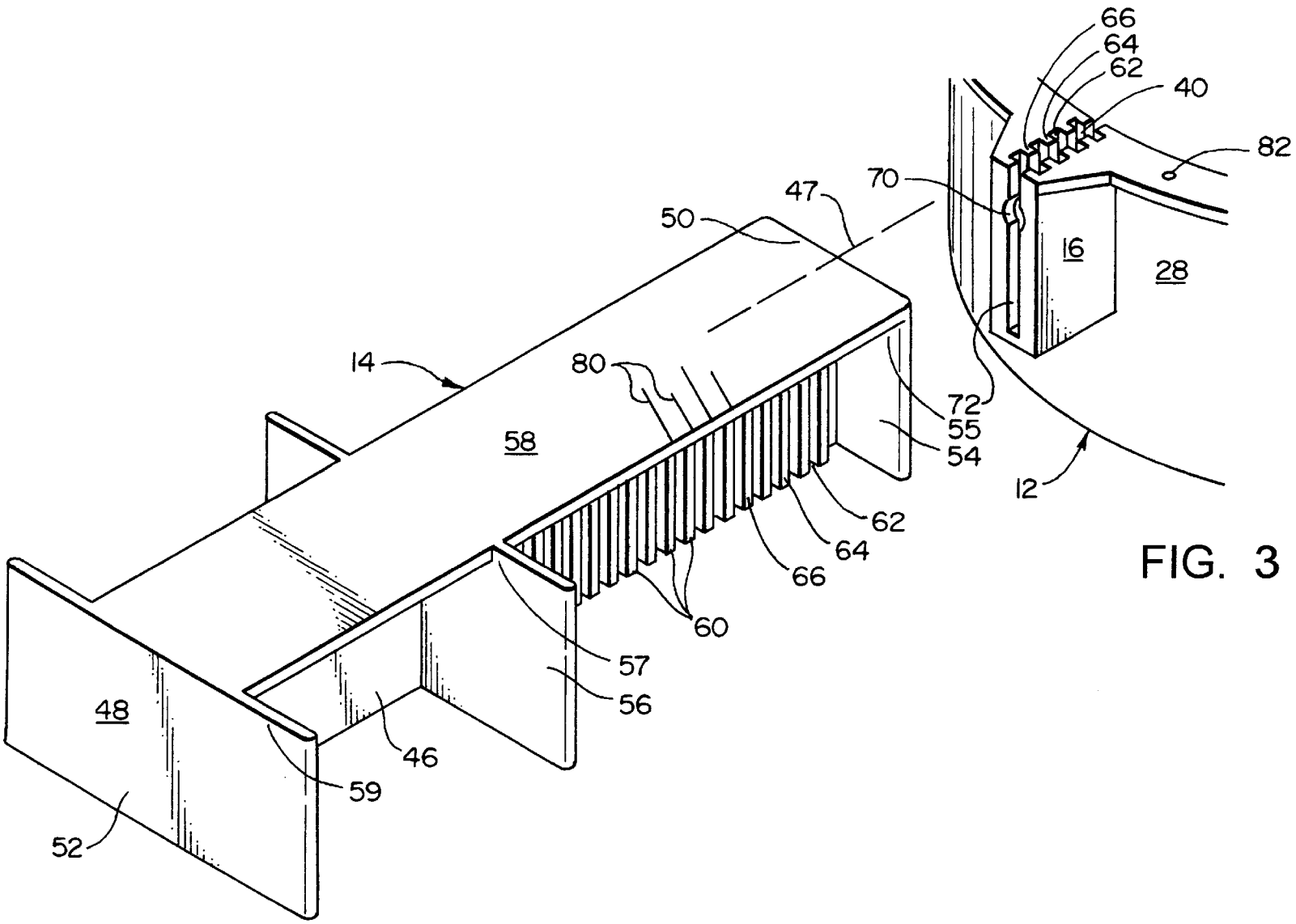
FIG. 3 is an enlarged view of the partially exploded section of the previous figure.

One of the stabilization arms 14 is shown in FIG. 3 and is comprised of vertically oriented planar stabilization rib 46 that extends along a longitudinal axis 47 radially from the central ground support collar 12. The stabilization arm 14 has a transverse planar support wall 54 at its anterior end 50. At a distal end 52, the stabilization arm 14 has a transverse planar stabilization wall 48. About two-thirds of the distance from the support wall 54 toward the stabilization wall 48 is an intermediate planar transverse wall 56 which also functions as a stabilization wall. A horizontally oriented planar cap wall 58 is joined perpendicularly to the top portion of the stabilization rib 46 and to the top end 55 of the support wall 54, the top end 57 of the stabilization wall 56, and the top end 59 of the stabilization wall 48.

The interlock portion 40 that is found in each gusset 16 on the central ground support collar 12 is a mirror image of the interlock portion 60 of the stabilization arm 14. For instance, in the preferred embodiment, the grooves 62 and ridges 64 of the interlock portion 40 of the gusset 16 are vertically oriented rectangles 66 that run nearly the full height of the gusset 16 and have a width of approximately ⅛th inch. The ridges 64 and grooves 62 are equally spaced and alternated in a manner that mirrors the corresponding grooves 62 and ridges 64 of the interlock portion 60 of the stabilization rib 46. To correspond to the placement of the grooves 62 and ridges 64 on the stabilization arm 14 there is, for instance, a ⅛th inch rectangular ridge, then a ⅛th inch rectangular groove, then a ⅛th inch rectangular ridge. The gusset 16 has a detente 70 on both sides of the interlock portion 40 which are positioned to receive the semi-spherical projections 68 (FIGS. 4 and 5) that are part of each groove on the interlock areas on both sides of the stabilization rib 46. The interlock portion 40 also defines a passage 72 through the gusset and cylindrical wall 28 to accommodate the stabilization rib 46 when the two interlock portions 40, 60 are joined.

The ⅛th inch increment in the interlock zones was chosen to allow for adjustment of the stabilization arms 14 in ⅛th inch steps. This is because the dimensions of a variety of standard elongated posts 18 are graduated in ⅛th inch increments, making the adjustment of the radial position of the stabilization arm 14 in this increment advantageous. The stabilization assembly is intended to be modular and adjustable so it can be adapted to a large range of post 18 sizes and shapes. Similarly, the stabilization arms 14 and the central ground support collar 12 can be made in a variety of sizes to accommodate various ranges of post 18 sizes with all the central ground support collars 12 and stabilization arms 14 interchangeable, to the extent practical.

Referring to FIG. 7, when assembled with central ground support collar 12, each stabilization arm 14 has a internal portion 74 that is resident inside the central ground support collar 12, an interlock area 75 where the interlock portions 40, 60 interfit, and an external portion 76 that extends outwardly from the central ground support collar 12. Each of these portions run coaxial with the stabilization arm 14 as it extends radially outwardly from the central ground support collar 12. The area 75 of the stabilization arm's 14 interlock portion 60 that is used to interfit with the interlock portion 40 of the gusset 16 sets the length of the internal portion 74 of the arm 14 and, more importantly, the position of the support wall 54. Together, the support walls 54 of the four arms 14 surround an area 78 in which the post 18 is located.

As shown in FIG. 3, the cap wall 58 of the stabilization arm 14 has a series of graduated marks 80 that correspond to the distance from the cylindrical wall 28 of the central ground support collar 12 to the support wall 54 of the stabilization arm 14 when the ground stabilization apparatus 10 is assembled. Alternatively, a plurality of marks could be used that show the position of the stabilization arm 14 when inserted into the gusset 16 for a variety of standard size posts 18, or the marks could be graduated to show the distance between the support wall 54 and the center of the central ground support collar 12. There is a reference mark 82 on the top of the gusset 16 for use with the graduated marks 80 on the stabilization arm 14.

Figure 4:
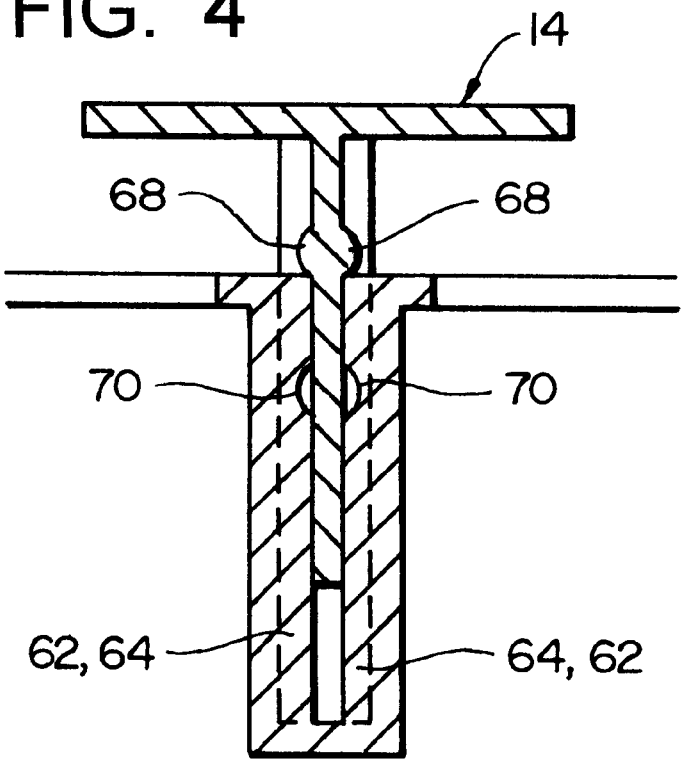
FIG. 4 is a cross-section view of the interlock means as a stabilization arm is inserted into the gusset on the central ground support collar.
Figure 5:
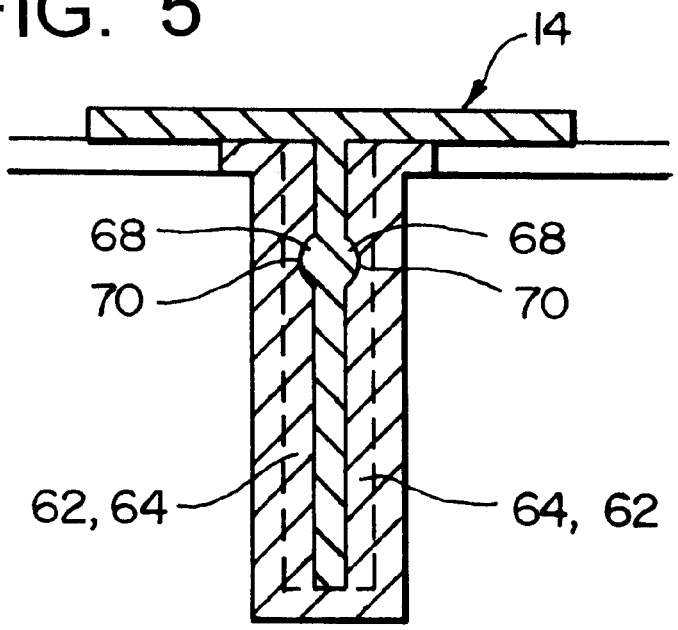
FIG. 5 is a cross-section view of the interlock means after stabilization arm has been inserted into the gusset on the central ground support collar.

The ground stabilization apparatus 10 is assembled by positioning the stabilization arm 14 over the gusset 16 so that one of the graduated marks 80 on the stabilization arm 14 that corresponds to the desired post 18 size lines up with the reference mark 82 on the gusset 16. This in turn aligns the grooves 62 of the stabilization arm 14 with the ridges 64 of the gusset 16 and the ridges 64 of the stabilization arm 14 with the grooves 62 of the gusset 16. The stabilization arm 14 is then pushed into the gusset 16 as is shown in FIG. 4, and the interlock is completed by continuing to push together the parts 14, 16 until the semi-spherical projections 68 on either side of the stabilization arm 14 are captured by the detentes 70 in the gusset 16 as is shown in FIG. 5. While the semi-spherical shape of the projections 68 allow for the removal of the arm 14 from the gusset 16 if they need to be repositioned, the combination of the ridges 64, grooves 62, projections 68 and detentes 70 provide a very stable and rigid interlock between the central ground support collar 12 and each stabilization arm 14. It should also be noted that only a small area 75 of the interlock portion 60 of the stabilization arm 14 actually interfits with the gusset 16. This is because the actual area 75 used depends on the position of the stabilization arm 14 when it is pushed into the gusset 16 which, in turn, is determined by the size of the post 18 that the ground stabilization apparatus 10 is being configured to accommodate.

Once the base 93 (FIG. 10) of the post 18 has been set in the post hole 26 and tamped within two to six inches below ground level, and the stabilization apparatus 10 is in place coaxial with the post hole 26, with the support walls 54 locked in place as near as possible to the post base 93, soil may be placed in the post hole 26 and shallow channels 92 and tamped to ground level. It is important to note that the support end of the arms 14 need only contact the post 18 when it is necessary to distribute a force applied to the post 18 by the fence. Therefore, while it is desirable that the support walls be in contact with the post 18, it is not required that the support walls 54 be continuously in contact with the post 18, nor do the support walls 54 need to conform to the shape of the post 18. As is illustrated in FIG. 6, a circular post 18 is as easily accominodated as is the square post 18 shown in FIG. 8. Unlike the devices described above in the back ground 24 art, the post 18 support is not secured to the post 18 because it is not intended to act as additional resistance attached to the base of the post 18. Rather, the purpose of the post 18 support is to keep the post 18 in position and to keep the post 18 from distorting its post hole 26. The cross-sectional shape of the post 18, therefore, is largely irrelevant. The post 18 can be square, rectangular, T-shaped, I-shaped, circular, or virtually any polygon shape.

The engagement of the supports is such that at least limited angular movement in a vertical plane between the arms and the post is possible so that as the post pushes against one or more of the arms 14 a lateral force is exerted but not any major rotational force that would tend to cause the arm or arms to rotate with the post if the post tends to slant from its upright position. The significance of this will be discussed later herein.

In the Figures, the post 18 is mostly depicted as having a circular shape, but as shown in FIG. 8, it could just as easily have a square cross section, or a hexagon, or an octagon, or other shape. For instance, if the shape of the cross-section of the post 18 has equal length sides, all of the stabilization arms 14 would be interlocked with the central ground support collar 12 so that the portion 74 extending into the interior of the collar 12 form a space 78 with equal distance between each of the support walls 54. If the post 18 has unequal sides, like a rectangle, two stabilization arms 14 could be set to provide for the width and the other two stabilization arms 14 could be set to provide for the height. The full surface area of the support wall 54 need not contact the post 18 in order for the ground stabilization apparatus 10 to perform as explained below.

The stabilization assembly is depicted in use in FIGS. 9–10. To install the ground stabilization apparatus 10, it is first assembled and configured to accept the actual size of the post 18 being installed. A post hole 26 is provided in the ground 24 for the reception of a base end of an elongated post 18. A shallow channel 90 is then created in the ground 24 coaxial to the post hole 26 for reception of the central ground support collar 12. (This channel is usually created along with the construction of the post hole 26 itself, and does not require additional labor). Similarly, shallow channels 92 that extends radially from the central ground support collar 12 and which are coaxial with the longitudinal axis 47 of the stabilization arm 14 are also provided for receipt of related stabilization arms 14. The shallow channels 90, 92 should preferably be about two to six inches deep. To complete the installation, the base end of the elongated post 18 is placed into the post hole 26, the post 18 adjusted to be plumb and square, and the base of the post 18 covered with soil and tamped to a depth two to six inches below ground level. The ground stabilization apparatus 10 is loosely configured and lowered over the post 18 and into the post hole 26 so that it comes to rest with its central ground support collar 12 and stabilization arms 14 within the provided channels 90, 92 and two to six inches below ground level. Final adjustments and locking of the ground stabilization apparatus 10 are now completed, and the entire unit is covered with soil and tamped to ground level. Over time, the post 18 support will continue to gain stability as the ground 24 around it compacts and roots begin to capture the ground stabilization apparatus.

As an example of using the invention, assume that the user wishes to build a fence using standard eight foot "4 by 4" posts 18. These posts 18 are nominally 3½ by 3½ inches square. The ground stabilization apparatus 10 is assembled by interlocking each of the four stabilization arms 14 with the central support collar 12 so that the four support walls 54 define a space 78 between them that is approximately 3⅝ inches to 3⅞ inches square. If the post 18 is larger or smaller than its nominal dimensions, the stabilization arms 14 can be easily adjusted to those non-standard dimensions by following the method described above for adjusting the interlock of the stabilization arm 14 with the central ground support collar 12. Then, as indicated above, a shallow channel 92 is then dug about 2 to 6 inches below the surface of the ground 24 for each of the four stabilization arms 14. This depends in large part on the nature of the ground conditions. As shown in FIG. 9, these shallow channels 90, 92 preferably conform closely to the shape of the stabilization apparatus 10, as this will increase the effectiveness of its use by disturbing as little ground 24 as possible.

As indicated above, it is important to note that the support walls 54 need only be near or adjacent to the post 18 rather than connected to it because the ground stabilization apparatus 10 is used to inhibit the post 18 from leaning rather than increasing the surface area of its base 93 to add additional resistance against the dirt that fills the post hole 26. This offers the added benefit that the ground stabilization apparatus 10 does not violate the integrity of the post 18 by requiring a penetration connection to it. Pressure treated lumber is impregnated with an insecticide. Once a hole 26 is drilled into the pressure treated post 18, it provides an avenue for insects to enter and eat the post 18 and for water to seep in and rot it. These disadvantages are eliminated because the ground stabilization apparatus 10 does not require physical attachment to the post 18, and need only be in contact with the post 18 when it is originally installed.

Figure 11:
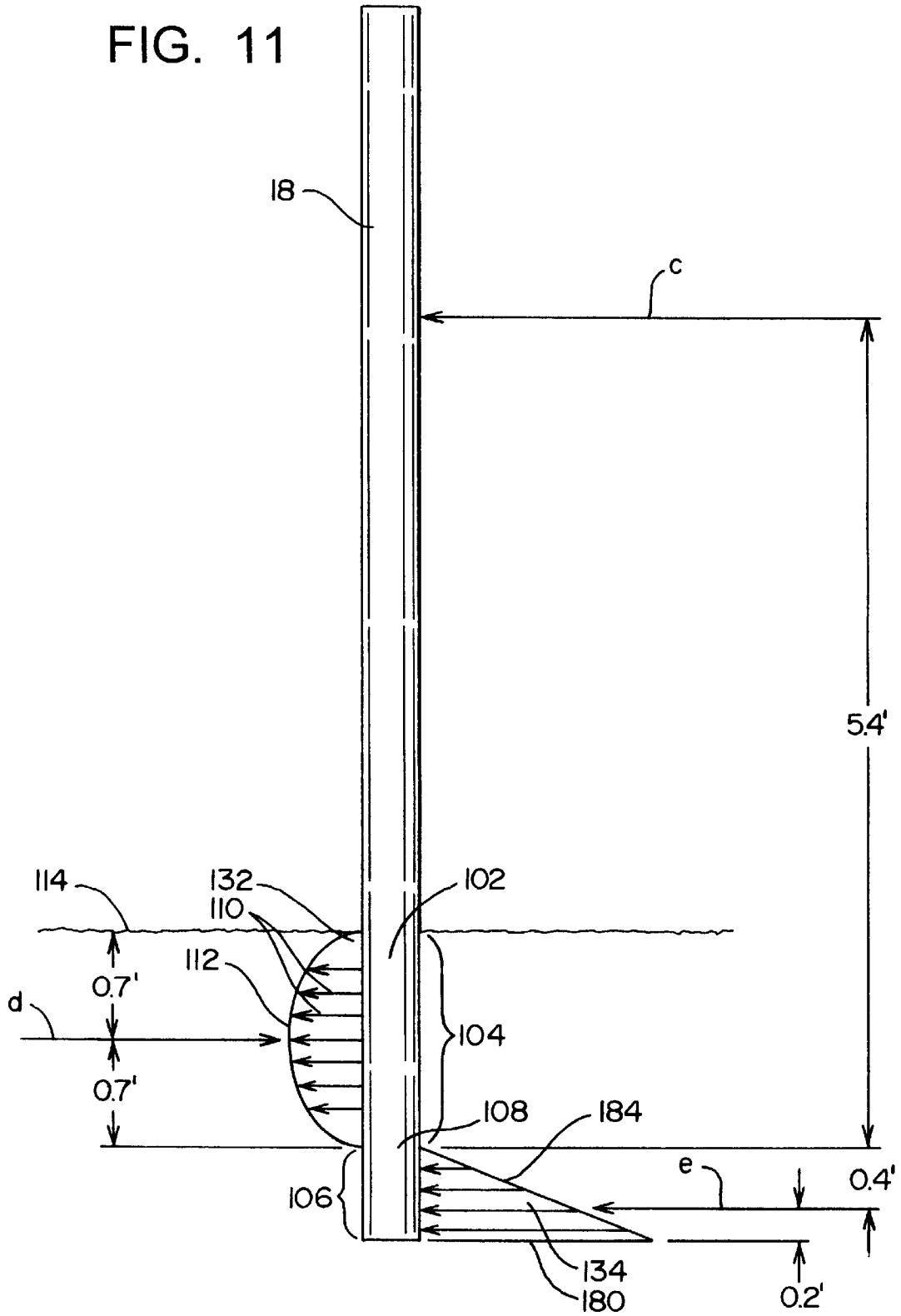
FIG. 11 is a somewhat schematic view illustrating the forces acting on a post placed in the ground in accordance with the prior art.

Before describing the operation of the present invention, let us first consider how the prior art method of placing a post in the earth functions. Reference is initially made to FIG. 11 which shows an eight foot long post 18 inserted into the earth at a depth, for example, of two feet. With the post 19 standing six feet above the ground. We will assume that the hole dug in the ground is only slightly larger than the width of the post, and that the ground around the post has been tamped in reasonably well. This represents the prior art method. Let us assume that there is a lateral force c applied against the post, such as an animal leaning against the post, snow drifting up against a fence which the post supports, or some other cause. This force c tends to rotate the post 18 in a counterclockwise direction (as seen in FIG. 11) so that it would lean to the left. For purposes of analysis, the portion 102 of the post 18 that is below the ground shall be considered as having an upper portion 104 and a lower portion 106, and these two portions of the post, in resisting the force c, act about a neutral location 108 which is at the juncture point of the post portions 104 and 106.

The earth to the left of the post portion 104 pushes against the left side of that post portion 104, and the resultant force is indicated at d. The earth to the right of the lower post portion 106 pushes to the left, as seen in FIG. 11, and the resultant force is indicated at e. As the force c is applied to the post 118, the post will begin to move to the left until the resisting forces d and e are sufficiently great to balance out the force c, at which time the post will become stationary.

With regard to the force d, this is the resultant of the summation of all the forces 110 which act along the left side of the post section 104. These forces result in a force distribution curve 112. It will be noted that this force distribution curve 112 is at a maximum at about the mid-height of the post section 104 and diminishes as this force distribution approaches the ground level 114, and also diminishes as these forces approach the neutral point 108.

The reason for this is as follows. If a lateral force is exerted against the ground near the surface 114, the ground near the surface more easily gives way than if the force is exerted at a lower location further below the ground surface. This can be explained more easily by referring to FIG. 11A. Let us assume that there is an earth formation where there is level ground at 116, and the edge of the ground 118 ends at a vertical cliff 120.

Quite obviously, if the ground structure 122 is of the nature of sand where the particles do not adhere to one another, the formation of this vertical cliff would be impossible, and the sand would sluff off to an angle of repose, which would normally be about 45°. However, if the particles of earth 122 adhere to one another with sufficient force, the cliff face 120 will remain stable. Let us assume now that a person is standing one foot away from the edge of the cliff and is exerting a downward force indicated at "f". This force f can be considered as having two force components perpendicular to one another. There is one force component "g" which is directed at a 45°angle to the force f and tends to compact the earth particles against one another. There is at a right angle to the force component g a second force component "h" which tends to cause the triangular shaped portion of earth 124 to slide away at a 45° angle. There is a shear plane 126 which resists this force component "h". However, when the downward force "f" becomes sufficient so that the earth particles are able to slide over one another along the shear plane 126, the triangular portion of the earth slips away.

Now let us assume that the person is standing, for example, ten feet away from the edge of the cliff at 118, and is exerting a force indicated at "j". The shear plane at 128 has a much larger area, and thus there is more resistance to slippage of the rather large mass of earth at 130 to slide along the plane at 128.

Let us assume now that the entire earth strata 122 becomes wet, so that the particles of earth tend to slide against one another more easily. (In technical terms, this means that the ability of the earth to resist the shear forces is reduced). When this happens, then large portions of the earth can slip away, and if the weight of the larger mass of earth 130 is sufficiently great to overcome the resistance to shear along the shear plane 128, the entire section of earth 130 will slip away.

Figure 11A:
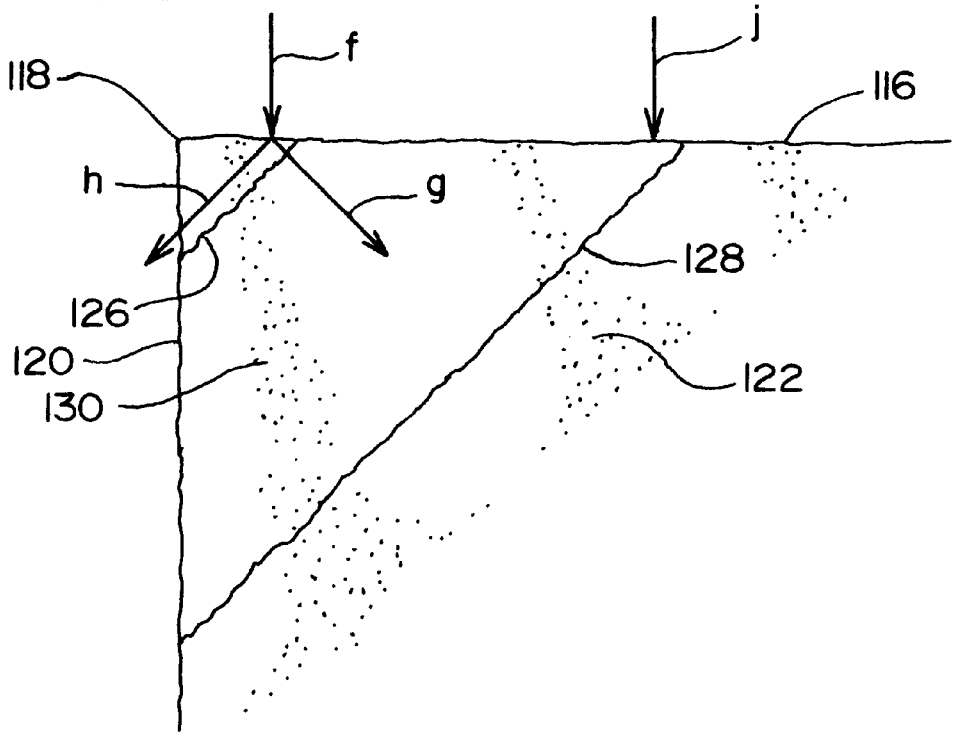
FIG. 11A is a somewhat schematic drawing illustrating the forces exerted on a ground formation and the effects of these.

Now let us relate this back to the post which we see in FIG. 11. If we simply consider that the section of earth in FIG. 11A is rotated 90° so that the earth surface 116 now becomes the left side of the hole in which the pole is positioned, let us consider a lateral force which is exerted by the left surface of the post against the upper portion of the earth. In the illustration of FIG. 11A, the force f is applied very near to the edge 118. We can compare this to a lateral force resulting from the post being pushed sideways to be exerted near the earth surfaces at the location 132 (See FIG. 11).

By applying the same reasoning used with reference to FIG. 11A, it can readily be seen that the earth near the surface of the earth can much more easily give way in shear. However, as the force is exerted at lower depth locations down the hole in which the post rests, the lateral resistance of the force against the post increases because of the greater mass of earth to be moved laterally and upwardly and because of the greater area of earth along the shear plane to resist the movement.

Thus, in FIG. 11, we see the forces increasing toward the middle of the left side of the post at the upper post section 104 that is beneath the ground. However, there is another factor which has an effect, in that is as we approach closer to the neutral point 108, the surface portions of the post closer to the neutral point 108 move a shorter distance laterally, thus compacting the earth less. The effect is that the lateral forces closer to the neutral location decrease, and at the neutral location 108 diminish to zero.

The situation with regard to the force "e" which is applied at a lower location is somewhat different. At the lower depth, the differences in the resistance of the earth to lateral deformation do not vary as much as the depth becomes greater. The shear effects, as described with reference to FIG. 11A, become less significant, and the resistance to lateral movement are more related to the resistance of the earth to being compressed. (However, this could vary, depending upon soil conditions and the magnitude of the forces being applied.) For this reason, the forces in the triangular area 134 are shown to be substantially proportional to the distance below the neutral point 108, which in turn are proportional to the amount of lateral deformation of the soil.

With the above being presented as background information, consideration will now be given to how the forces "c", "d", and "e" act in the situation in FIG. 11, which shows the prior art arrangement.

There are two sets of forces to be considered. First, the set of lateral forces c, d, and e must all balance. Since the two forces c and e are exerted to the left, and the force d is exerted to the right, the force c and the force e must equal the force d. Second, all of the moments (which act as rotational forces) also must all balance. The magnitude of the moment is equal to the force times the moment arm. In this particular instance, with the point 108 being the neutral point, the moment of the force c is equal to the magnitude of the force c times the distance from the point 108 perpendicular to the force c. In FIG. 11, this is shown to be 5.4 feet.

The moment of the force d is equal to the magnitude of the force d times 0.7 foot, which is the perpendicular distance from this force d to the point 108. The magnitude of the force exerted by the force e is the magnitude of the force e times the perpendicular distance to the neutral point 108 which is 0.4 feet.

The equations which apply are as follows. For the lateral forces to balance out, we have the following formula:

$$c+e=d$$

For moments to balance, we have the following formula:

$$5.4c=0.7d+0.4\,e$$

Let us assume that the force c is 100. In that case, the formulas would be as follows:

$$100=e-d$$

and $$540=0.7d+0.4e$$

Next, we solve these equations by using simple algebra, and we cancel one of the unknowns out of the equation and find d=527 lbs Then we solve for e and find e=427 lbs The above analysis of the manner in which the forces are applied and reacted in the prior art method is given as background information.

Figure 12:
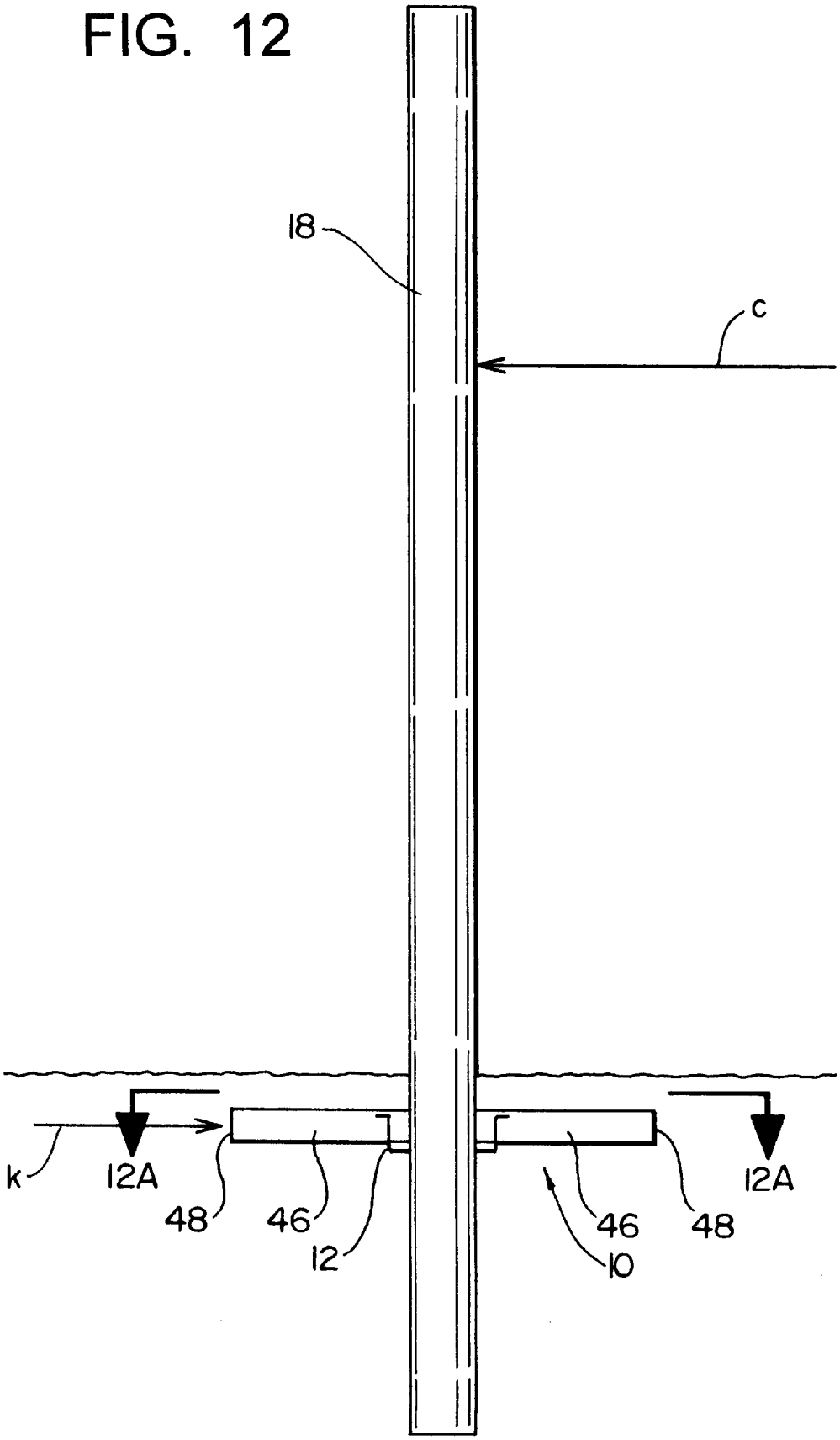
FIG. 12 is a view similar to FIG. 11, but showing the addition of the present invention.

Now let us perform a similar analysis relative to the present invention. Reference is first made to FIG. 12, which shows the ground stabilization apparatus 10 somewhat schematically, and there are shown the collar 12, along with two of the stabilization walls 48, and their ribs 46. (For ease of illustration only one stabilization wall 48 is shown for each rib a 46.) Then the same force "c" (as shown in FIG. 11) is shown as being applied against the post at a location four feet above the ground surface. The stabilization apparatus 10 exerts a lateral force which in FIG. 12 is shown at "k".

Figure 12A:
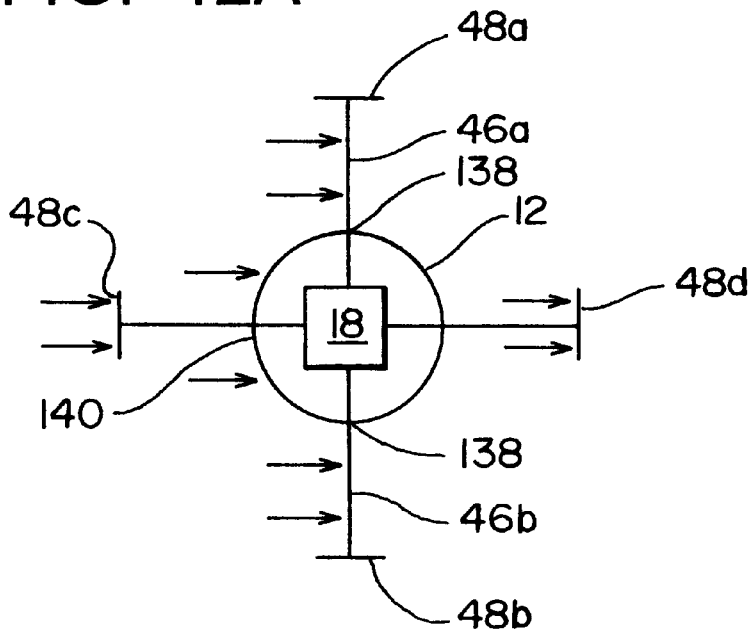
FIG. 12A is a section view taken along 12A—12A of FIG. 12.

To appreciate how this lateral force "k" is accomplished, reference is now made to FIG. 12A. (Again, only one stabilization wall 48 is shown for each rib 46.) It should be recognized that as the post 18 is pushed laterally to the left, not only does the left stabilization wall 48*c* resist this by reacting the force exerted by the wall 48*c* into the earth immediately to the left, but the opposite stabilization wall

48*d* does the same. The amount of the force exerted by each wall 48 is proportional roughly to the area of each of these two stabilization walls 48. In addition, the circumferential collar 12 bears against the soil immediately to its left, and this force against the collar 10 is also reacted into the post.

Further, there are the two ribs 46*a* and 46*b* which extend at right angles to the forces exerted laterally by the two stabilization walls 48 as seen in FIG. 12. Each of these ribs 46*a* and 46*b* is connected at 138 to the collar 12. Therefore, when the post 18 is pushed to the left, as seen in FIG. 12A, this also tends to push the ribs (designated as 46*a* and 46*b*) to the left also. Since these two ribs 46*a* and 46*b* are anchored at their outer ends to the related stabilization walls 48*a* and 48*b*, these also resist the force against the post 18 by pressing against the earth immediately to the left of these two ribs 46*a* and 46*b*. (However, the distribution of the resisting forces against the ribs 46*a* and 46*b* are not uniform, but decrease radially outwardly.)

Also, it should be recognized that since these various reaction points of the stabilization apparatus 12 press against the earth are spaced a sufficient distance horizontally from one another, the loads are better able to be distributed into the earth formation and thus overall produce a greater total force. For example, let us examine the two stabilization walls 48*c* and 48*d* which directly resist the lateral force. When a force is pressed against an earth formation, the effect of this force is distributed not only straight ahead, but also in an outward slant in all directions. A common application of this can be observed when a force is exerted at the earth surface downwardly. The earth immediately below the load is compacted very heavily. However, further down at one foot, two feet, three feet, etc., the effect of the force becomes substantially less since it is dispersed over a greater area.

Applying, for example, to the force that is applied by the stabilization wall 48*c* and 48*d* laterally against the earth, this force is spread not only laterally, but also downwardly and horizontally outwardly into the earth's formation. Also, the force exerted at the location 140 by the collar 12 is distributed laterally and downwardly. Since the stabilization walls 48*c* and 48*d* and the collar surface portion 140 are spaced far enough apart, these components are better able to generate a relatively large resisting force.

Figure 12B:
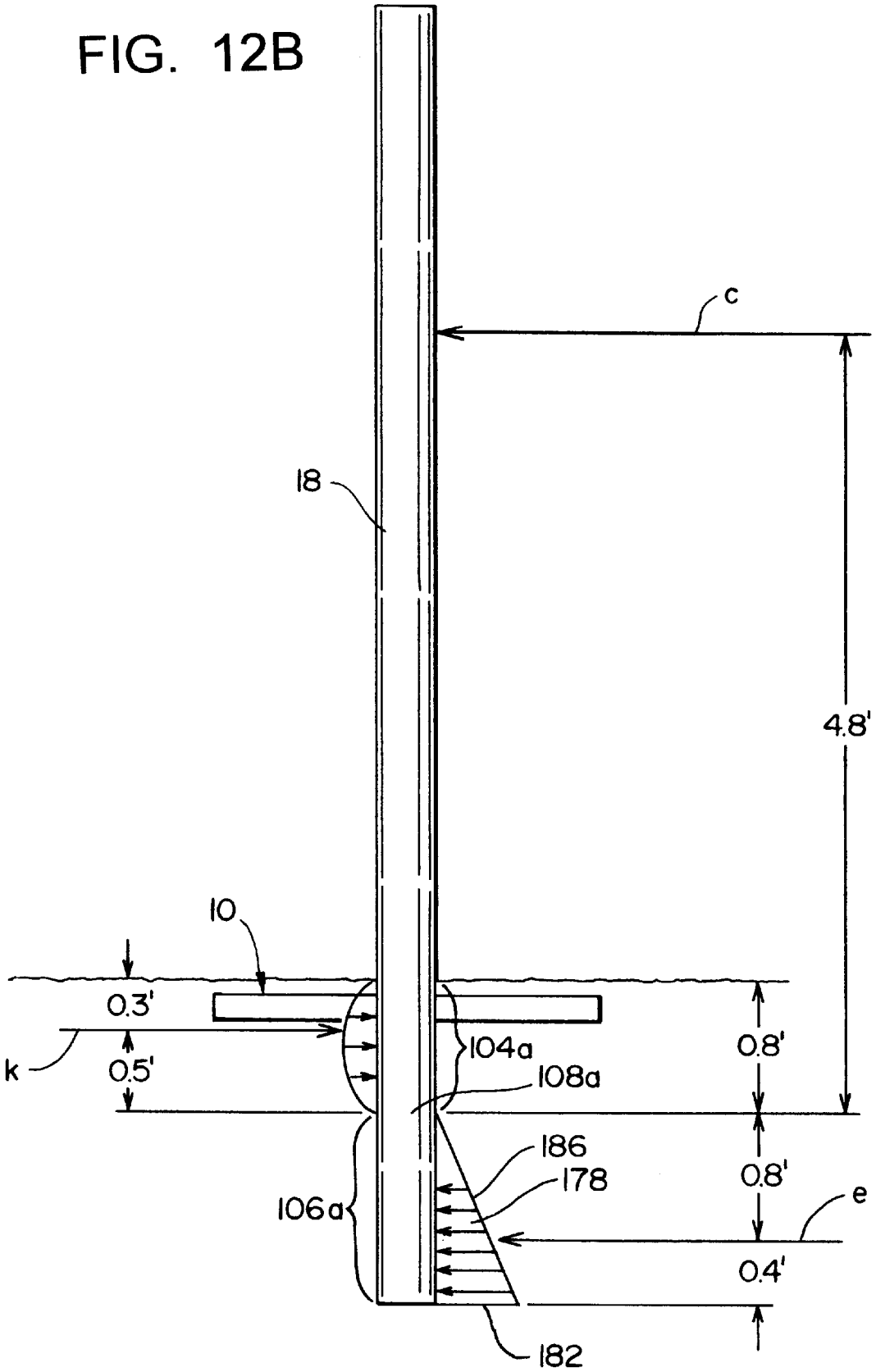
FIG. 12B illustrates the manner in which the forces would react against the post utilizing the present invention, as shown in FIG. 12.

Another factor to be considered is that in its optimum position, the stabilization apparatus 10 is closer to the earth's surface. The effect of this will now be discussed with reference to FIG. 12B. In FIG. 12B, the lateral force exerted by the stabilizing apparatus 10 is illustrated at "k". It will be noted that with this force "k" being added by the present invention, the amount of lateral movement at the location of the force "k" would be substantially less than what would be experienced in the prior art situation of FIG. 11.

That would mean that the neutral point 108*a* in FIG. 12B would be raised. The effect of this is that the force "e" in FIG. 12B would be acting about a longer moment arm which is indicated in FIG. 12B as being 0.8 feet as opposed to a moment arm of 0.4 as shown in FIG. 11. For this reason, the deformation of the earth at the lower portion 106*a* of the post will be less, and the lateral movement of the lowermost point of the post will be less.

These several factors act together in what might be called a synergistic manner or in mathematical terms "exponentially" so that the overall effect in properly aligning the post is multiplied by these three factors.

To explain this, reference will now be made to FIG. 12C through 12H, which are rather idealized representations given to explain the underlying principles. This analysis which will be given below with reference to FIGS. 12C–12H is not intended to show precisely how the advantages of the present invention are obtained, but rather to show in general the advantages that can be obtained by increasing the length of the moment arms about which the forces are reacted into the base potion of the post. The obvious conclusion is that substantial advantages are obtained by digging a deeper hole for the post. However, as will be discussed further on in this text, a substantial benefit can be obtained in the present invention by a proper application of these principles without having to dig a deeper post hole.

Figure 12C:
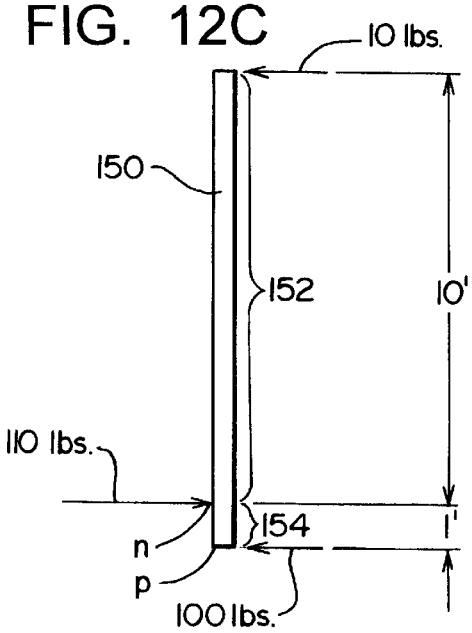
FIGS. 12C through 12H are schematic drawings showing the manner which force components would be applied to a post under different idealized conditions, this being done to illustrate certain underlying principles upon which the present invention is based.

In FIG. 12C, there is shown a wood pole 150 eleven feet long, where there is a force of ten pounds exerted about a moment arm of ten feet, indicated at 152 about a point "n", and this is resisted by another force of one hundred pounds exerted at the point "p" about a moment arm of one foot, indicated at 154. The lateral force at the point "n" is 110 pounds. The forces are now in balance.

Figure 12D:
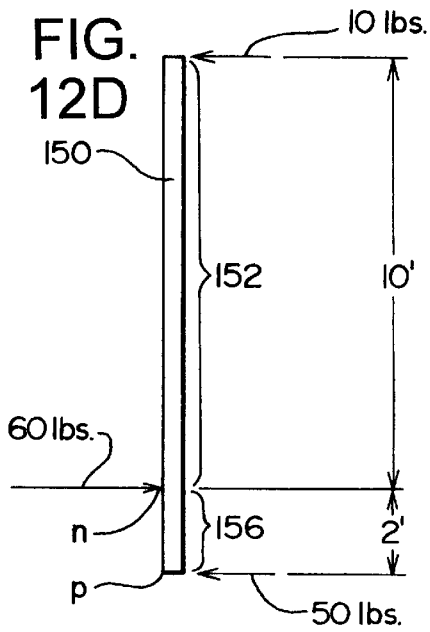

Now we go to FIG. 12D, which shows the same situation as in FIG. 12C, except that the lower moment arm has been increased to two feet as indicated at 156, so that the pole 150 is twelve feet long. It can be seen that the balancing force to counteract the ten pound force is now fifty pounds, and the resisting force at the point has been correspondingly reduced down to sixty pounds. Let us further assume that the deflection at the resisting point "p" acts like a spring, so that the deflection is proportional to the applied force. If so, the deflection at the point "p" in FIG. 12D would be half the deflection of the point "p" as shown in FIG. 12C.

Figure 12E:
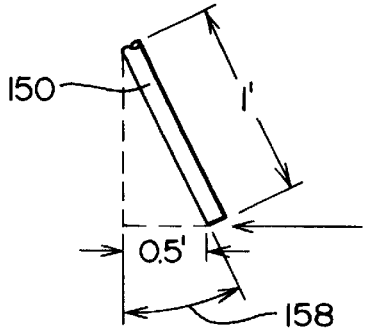

Now let us examine what sort of angular deflection would result in the pole which is being deflected. In FIG. 12E, there is shown schematically the lower part of the pole 150 which has a shorter lever arm of one foot, and is being deflected 0.5 feet. The angular deflection is shown at 158 and is 300.

Figure 12G:
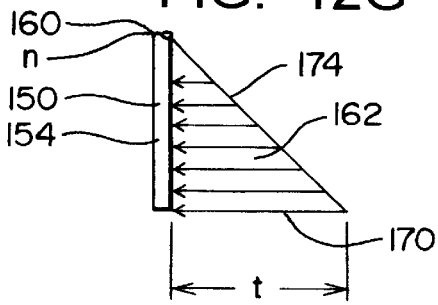
Figure 12F:
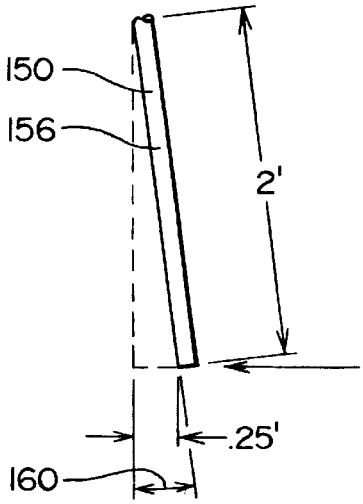

Now reference is made to FIG. 12F where the lever arm is two feet long, twice as long as in FIG. 12E, but with the force being one half the force of FIG. 12E, the deflection is only 0.25 feet. Now it can be seen that the angle 160 of the post portion 156 is about 7°, which is about one quarter of the angle 158 in FIG. 12E. Thus, it can be seen that by doubling the length of the lever arm, the angular deflection of the lever arm is reduced four times. But this is only the first part of the analysis. Another important factor must be considered, and this is the area of the post portion 154 that is pressing laterally against the earth.

Figure 12H:
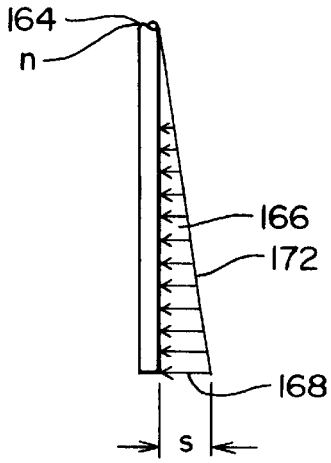

Let us now turn our attention to FIGS. 12G and 12H where there is shown (in FIG. 12G) a lower part 154 of a post 150 which is being deflected about the point 160 which can be considered a neutral stationary point "n", and the summation of the resisting forces applied against the lower right surface are designated by the forces within the triangle 162.

Now if, as in FIG. 12H, we raise that neutral point "n" to twice the height to be at 164, and if the same lateral force is being applied at the upper part of the post at a location one foot higher, the effective application of the total resisting force is only one half of that required in FIG. 12G. However, as indicated in the above paragraph, there is an additional consideration with regard to the resisting force of the vertical surface of the earth strata against the side surface of the post. In the situation of FIG. 12H, the lateral surface over which the force of supplied has been doubled, in comparison with FIG. 12G. Therefore, the resisting force which must be applied by each square unit of area to the earth adjacent to the lower part of the post needs to be only one quarter (in the arrangement of FIG. 12H), as it needs to be in FIG. 12G.

To explain this in other terms, the summation of all of the forces within the triangle 162 is equal to area of that triangle, and the summation of all the force components in the triangle 166 of FIG. 12H are equal to the area of that triangle. Thus, if the triangle 166 is half the area of the triangle 162 and double the height, then the length of the base 168 of the triangle 166 (indicated at "s") is one quarter of the length of the base 170 of the triangle 162 (indicated at "t"). The hypotenuse side 172 of the triangle 166 is slanted from the vertical only one eighth of the slant of the hypotenuse side 174 of the triangle 162.

In this somewhat idealized example, it is assumed that the compaction of the earth would be proportional to the force applied. However, it may not be a direct proportional relationship, and the resistance of the earth to compression for a certain percentage of compaction may vary greatly, depending upon the characteristics of the soil and other factors, and also may not have a direct proportional relationship. Thus, for example, if the resisting force increases in some relationship greater than a direct proportional relationship (e.g. increasing by an amount equal to the amount of deflection squared), these computations would have to be adjusted to account for this.

To put this in a more practical framework, let us return to FIG. 11, where the neutral point is shown at 108. If it were possible to raise that neutral point "n" to twice the height that is shown in FIG. 11 and if the force applied to the post remained the same height above the neutral point, the following would occur. Three things would happen. First, since the moment arm about which the force "e" is acting is now greater, the resisting force required by the force "e" is diminished accordingly. If we assume that the resistance of the earth to the compaction is one half of the amount of movement of the earth, when we raise the neutral point 108 to twice its height, there is twice the amount of earth that is pressing against the right side of the portion 106 of the post, which is now twice its height. Therefore, with twice the amount of earth resisting compaction and with the resisting force being required to be one half of what it was before, the lateral deflection of the bottom part of the post is not just one half of what is shown in FIG. 11 but actually less than one half.

With the foregoing being given as background information, let us return to the situation shown in FIG. 11, and assume that the present invention has now been utilized in this particular arrangement where the post is eight feet long, with six feet of the post extending above the ground surface, and the lower two feet of the post being below the ground surface, so that we have the situation of FIG. 12B.

Now let us perform calculations with regard to the situation of FIG. 12B, similar to those conducted with the situation in FIG. 11. We start with the formula for the lateral forces to balance out which is:

$$c+e=k$$

For the moments to balance, we have the following formula:

$$4.8c=0.5k+0.8e$$

On the same assumption that the force c is 100, then the formula would be as follows:

$$100=k-e$$

and $$480=0.5k+0.8e$$

Next, we solve the equations by using simple algebra, and we cancel one of the unknowns out of the equation and find:

$$k=430 \text{ lbs}$$

Then we solve for e and find:

$$e=330 \text{ lbs}$$

The next step is to look at the pattern of distribution of forces of the force e of FIG. 11 (shown by the triangle 134), and the force distribution of the force e applied in FIG. 12B (indicated by the triangle 178). The height of the triangle 178 in FIG. 12B is 1.2 feet, which is twice the height of triangle 134 of FIG. 11, which is the in 0.6 ft. Yet, the force e in the situation of FIG. 12B is 330 pounds, while the force e in the situation of FIG. 11 is 427 pounds. This means that the ratio of the total areas in the triangle 134 to the triangle 178 is equal to the ratio of 427 to 330 which is about 1.3 to 1. The practical effect of this is that the base 180 of the triangle 134 in FIG. 11 is 2.6 times longer than the base 182 in FIG. 12B. With the height of the triangle 178 is FIG. 12B being twice the height of the triangle 134 in FIG. 11, the slope of the hypotenuse 1.4 of the triangle 134 of FIG. 11 is 5.2 times the slope of the hypotenuse 186 of the triangle 178 in FIG. 12B.

Another desirable feature of the present invention results from the fact that the engagement of the arms with the post is such that at least limited rotational movement in a vertical plane is permitted between the arms 14 and the post to substantially isolate any rotational force component on the arms. This enables the vertical surfaces of the apparatus to exert their lateral forces more uniformly. Thus the entire surface areas that are load bearing are used more efficiently, and the arms 14 and other components are relieved of bending moments that would otherwise be imposed on the apparatus.

Therefore, in this mathematical model, as presented in FIGS. 11 and 12B, with the same force applied (Force "c" which is 100 pounds) to the post 10 at the same location, first without the present invention and second with the present invention, there is a fivefold increase in the ability of the post to resist angular movement of the post. It should be emphasized that the more than fivefold increase in stability has been achieved not by digging a deeper post hole to obtain the advantages discussed with reference to FIGS. 12C–12H, but by applying the relevant principles in such a way that the application of the forces are optimized to obtain such benefits by use of the present invention.

At this point, it should be emphasized that this analysis which has been presented with reference to FIGS. 11 and 12B (with FIG. 11 showing the distribution and effect of forces on the post without the present invention and FIG. 12B showing the distribution and effect of forces using the present invention) is not based upon experimental results, but is based upon mathematical calculations which are further based upon assumed data. This is done to illustrate the operating principles of the present invention in a practical environment, and is not intended to demonstrate that this magnitude of improvement would necessarily be expected by using the present invention.

To explain this further, one assumption that has been made is that the movement of the post surface against the adjacent earth surface would be proportional to the force applied. As indicated above, this may well not be a relationship in direct proportion, but in relation to some other function, where the applied force, when doubled, would result in an increase of compaction of the earth, but not necessarily twice that amount. Also, the soil conditions could vary greatly. For example, the two feet depth of this particular portion of earth may have an upper layer of rather hard clay which is very resistant to compaction, and the ground one to two feet down may be much more easily compacted.

Nevertheless, it is believed that it can be stated with quite reasonable justification that the underlying principles presented as to the operation of the present invention relative to the application of these forces do apply in the manner generally indicated in this preceding analysis, and that there will be a significant increase in the resistance of the post to tilting by using the present invention.

From the above analysis, it becomes apparent that if the resisting force supplied by the apparatus of the present invention is transmitted into the post at a higher location, without diminishing the ability of the apparatus to resist lateral movement, the post will be better stabilized. However, if the apparatus is placed immediately adjacent to the ground surface then (depending upon the ground conditions) the ground itself is more likely to give way laterally. As the depth of the stabilizing apparatus increases, the ability of the soil to resist the lateral forces increases. However, at the same time the moment arm about which the force decreases with greater depth. Therefore, we have something of a "balancing act" as to the optimized depth at which the apparatus is to be placed.

Also, this will depend to some extent on the nature of the soil. For example, if the upper half foot of the soil has a high percentage of organic matter that is more easily compressible, then obviously this soil would provide less lateral resistance, and it would be desirable to place the stabilizing apparatus more deeply. Also, this may indicate that the post hole itself should be dug more deeply to find its support in ground strata that is more resistant to compression.

In general, assuming soil conditions that are reasonably consistent at levels all along the depth of the post hole, the depth of the apparatus positioned in the soil would be no greater than about one quarter of the depth of the post hole. It could be placed at greater depth, but (as indicated above) this may shorten the moment arm about it would act sufficiently so that its overall effectiveness would actually diminish. Further, there would be the greater labor of having to dig the channels for the arms of the apparatus at a deeper level.

On the other hand, if the earth strata near the surface is highly resistant to compression, it may well be advantageous to position the apparatus very close to the surface of the earth's strata so that the moment arm about which the apparatus acts is longer, and very little is lost with respect to the ability of the soil strata to resist compression. In general, for a two foot post hole, desirably the stabilizing apparatus would be positioned where its average depth in the soil would be between two inches to seven inches, with a preferred range being between three to six inches or four to six inches.

Figure 13:
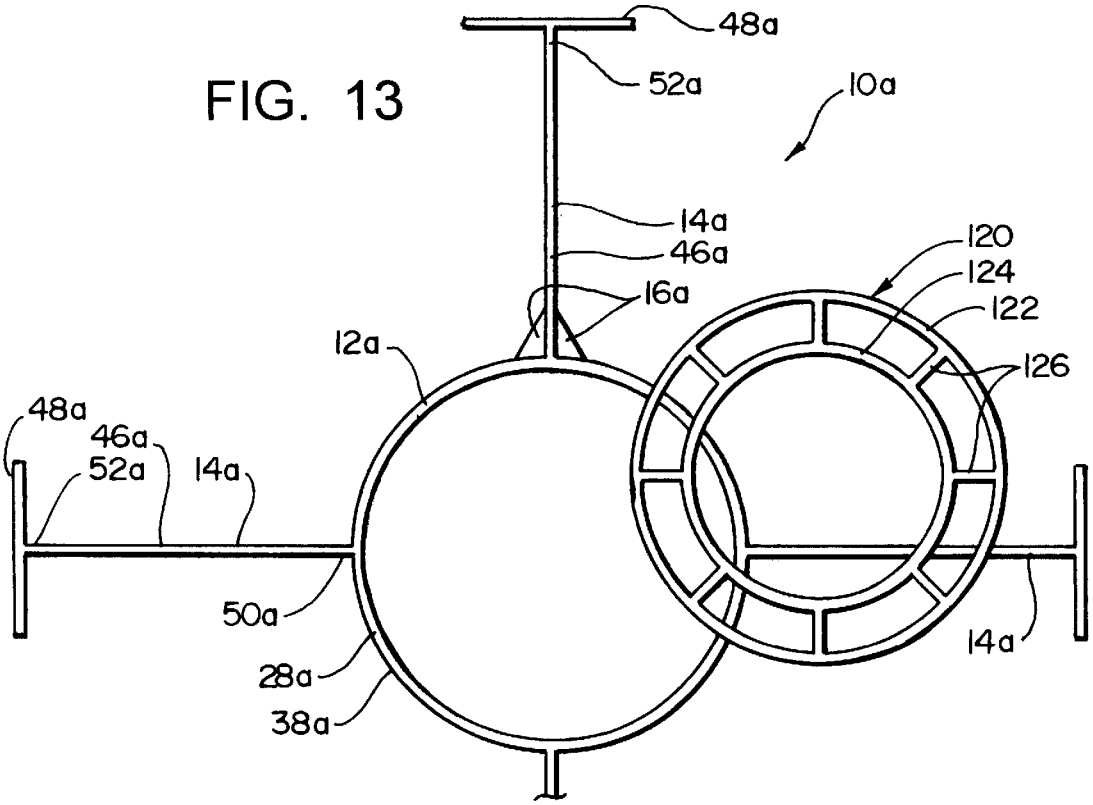
FIG. 13 is a partially exploded partial plan view of an alternative embodiment of the invention.
Figure 14:
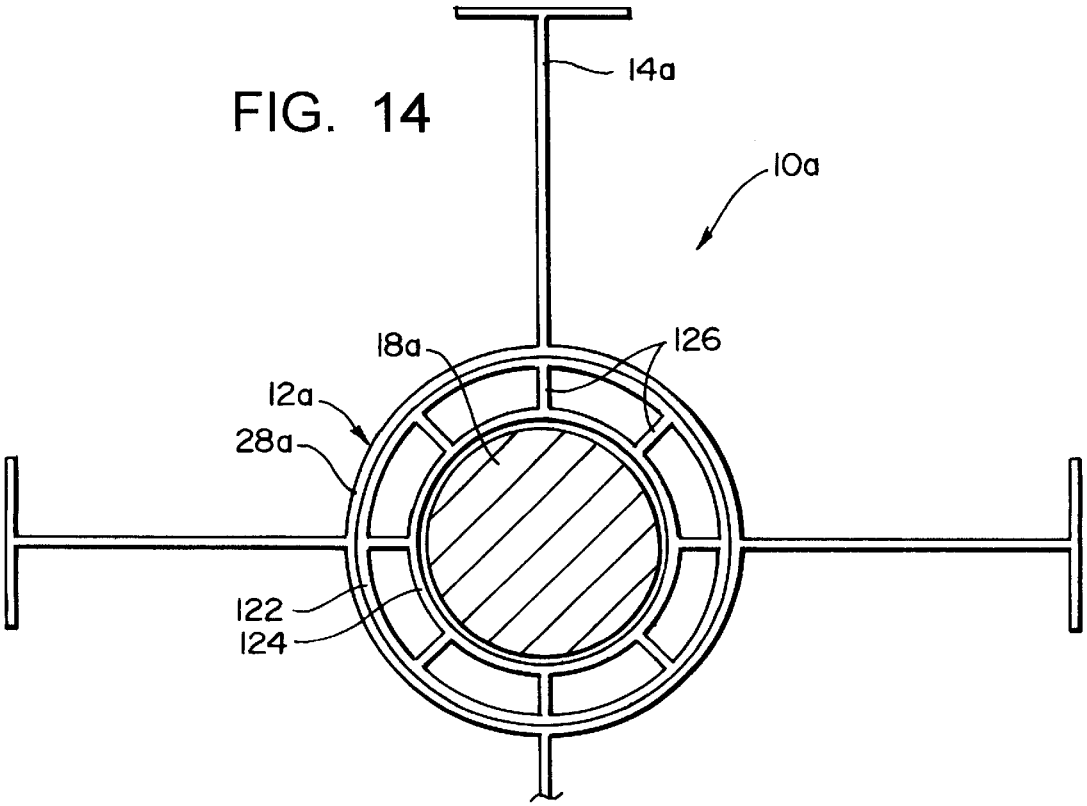
FIG. 14 is a partial plan view of an alternative embodiment of the invention configured for a post of predefined size.
Figure 15:
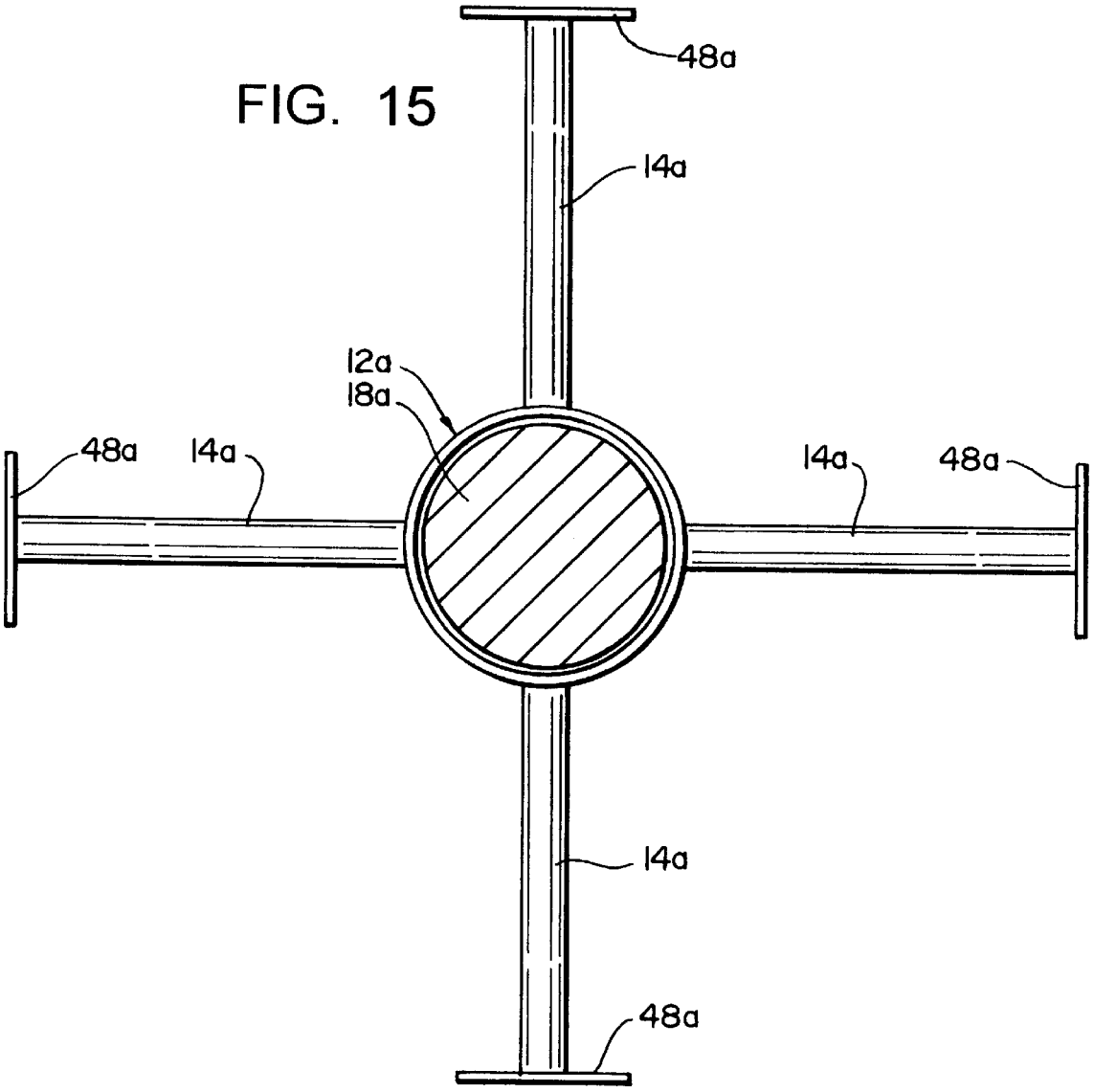
FIG. 15 is a plan view of an alternative embodiment of the present invention.

An alternative embodiment of the ground stabilization apparatus 10*a* is shown in FIGS. 13–15. In this embodiment, the central ground support collar 12*a* and the stabilization arms 14*a* are made as a single unit. Each stabilization arm 14*a* has a stabilization rib 46*a* that is coaxial with a radially extending longitudinal axis and has a transverse stabilization wall 48*a* at its distal end 52*a*. The anterior end 50*a* of the stabilization rib 46*a* is joined to an outer surface of the central ground support collar 12*a*. If desired, a gusset 16*a* could be provided at this junction.

The central ground support collar 12*a* may be used with an adapter member 120, as is shown in FIGS. 13–14, or without an adapter member 120 as is shown in FIG. 15. The adapter member 120 is comprised of an outer adapter ring 122 that is sized to fit into and be held by the cylindrical wall 28*a* of the central ground support collar 12*a*, an inner adapter ring 124 that is sized to accept a post 18*a* of predetermined dimensions, and a plurality of support ribs 126 that join the inner adapter ring 124 to the outer adapter ring 122. The interior adapter ring could, of course, be fabricated to accept any shape post 18*a* so that an adapter member 120 could be provided for round posts 18*a*, square post 18*a*, T-shaped posts 18*a*, etc.

This alternative embodiment is approximately the same size and is used in the same way as is described with regard to the preferred embodiment, except an adapter member 120 is used to configure the ground stabilization apparatus 10*a* for a particular post 18*a* size rather than by adjusting the positions of the stabilization arms 14*a*.

The ground stabilization apparatus 10 is preferably made from a relatively rigid (but with some flexibility), non-breakable and high impact plastic such as high density polyethylene or polypropylene. Consideration should be given to the durability of the various materials in different temperature extremes, as the ground stabilization apparatus 10 can be used in climates where the ground freezes in the winter, as well as very warm climates. The ground stabilization apparatus 10 can also be made from an elongated metal section such as steel rebar; the pieces of which are bent and welded into the shape of the ground stabilization assembly.

To summarize some of the significant aspects of the present invention, the following comments are provided. First, it is evident that there has been a long felt need for practical improvements in installing posts at a ground location so that the lower end of the post is provided with a stable base to have substantial resistance to the tilting of the post. There is a very substantial quantity of posts installed yearly (worldwide), and yet (to the best knowledge of the applicant) the most common method of attempting to improve the stability of the post is to pour large quantity of concrete into a large post hole. This is costly, wasteful, and labor intensive and difficult to repair. Further, the analysis performed in connection with the present invention indicates that in large part the prior art concepts have been based on analyses rather different than those upon which the present invention are based. The present invention is not based upon a concept of simply expanding the underground surface area of the post. Rather, the present invention distributes the load at a location closer to the ground surface and distributes this laterally out into the surrounding earth at an upper location, thus effectively increasing the moment arm about which the forces within the soil are applied and increasing stability. Also, present analysis indicates that use of the present invention accomplishes this task more effectively, and yet in a less expensive and more convenient manner, and further with less material waste.

While this invention has been described in terms of its preferred embodiments, it is contemplated that persons reading the preceding description and studying the drawing will realize that various alterations, permutations and modifications thereof are possible. It is therefore intended that the following appended claims are interpreted as including all such alterations and modifications as fall within the true spirit and scope of the present invention.

What is claimed:

1. A method of installing a post into a ground strata, said method comprising:

a) providing in the ground strata a post hole having a post hole depth dimension;

b) inserting a lower end portion of the post into the post hole to position the post in an upstanding position;

c) excavating channels in an upper portion of the ground strata surrounding the post hole in a pattern where the channels extend outwardly from the post hole at regularly angularly spaced locations;

d) locating a central collar having a center opening with a width dimension at least as great as a width dimension of said post around said post;

e) locating a plurality of stabilizing arms in said channels so as to be positioned at angularly spaced locations around the collar and attached to the collar so that with each of said arms having a radially inward end portion connecting to said collar and positioning the arm with a radially inward end of each arm being sufficiently close to the post to resist a lateral force applied by the post to tilt the post laterally and a radially outer portion of the arm is extending outwardly from said collar;

f) locating at an outer portion of each arm a stabilizing wall so that each wall has a substantial alignment component transverse to a lengthwise axis of its related arm;

g) filling the channels with fill material to embed the arms and the walls in an upper portion of the ground strata whereby lateral tilting of the post is resisted by the radially inward end portions of the arm in a manner that limited rotation of the post relative to a plane occupied by the arms is permitted.

2. The method as recited in claim 1, further comprising releasably connecting said arms to the collar.

3. The method as recited in claim 2, said method further comprising positioning said arms by connecting each of said arms in a selected position, so as to be in contact with, or closely adjacent to, said post, whereby said apparatus can be utilized to stabilize posts having different width dimensions.

4. The method as recited in claim 3, further comprising interconnecting a tongue and groove connection at a selected tongue and groove connecting location selected from a plurality of linearly spaced connecting locations.

5. The method as recited in claim 3, said method further comprising positioning said arms in accordance with complimentary graduated marking means on the arms related to width dimensions of the posts.

6. The method as recited in claim 1, further comprising fixedly attaching said arms to said collar.

7. The method as recited in claim 1, further comprising inserting an adapter means around said post and within said collar means to provide a bearing surface on said insert in contact with, or closely adjacent to, said post.

8. The method as recited in claim 1, further comprising excavating said channels to a depth of no greater than about one/half foot, so that said arms are positioned so that bottom portions of said arms and the stabilizing walls have a depth no greater than about one/half foot below ground surface.

9. The method as recited in claim 1, further comprising positioning the stabilizing wall on each arm at a distance from the post greater than one/half foot.

10. The method as recited in claim 9, further comprising locating said stabilizing wall at least as great as about three/quarters of a foot from the post.

11. The method as recited in claim 9, further comprising positioning a second stabilizing wall connected to each of said arms radially inwardly from said stabilizing wall.

12. A combination of a post positioned in a ground strata and a stabilizing apparatus positioned around said post and in said ground strata, said combination comprising:

a) said post having a lower base portion positioned in the ground strata, and an upper portion extending upwardly from the ground strata;

b) said stabilizing apparatus comprising:

i. a collar means having a center opening with a width dimension at least as great as a width dimension of the post;

ii. a plurality of stabilizing arms positioned at angularly spaced locations around the collar means each of said arms having a radially inward end portion connecting to said collar means and an radially outward portion extending radially outwardly from said collar means;

iii. each of said arms having at the outer portion stabilizing wall means having a substantial alignment component transverse to a radial axis of its related arm;

c) radially inward port ions of said apparatus engaging said post in a manner to permit at least limited relative rotational movement of the post relative to a horizontal plane occupied by the apparatus, said apparatus being positioned in the earth strata so that the apparatus is in contact with an upper part of the base portion of the post or in close proximity thereto, and said apparatus is located in an upper portion of the earth strata at the same level as the upper part of the base part of the post, so that force loads imposed on said post are reacted laterally from the post into the apparatus and thus into the surrounding earth strata at the same level as the upper part of the base portion of the post substantially as lateral loads into the earth strata that is at the same level as the upper part of the base portion of the post.

13. The combination as recited in claim 12, wherein the stabilizing well means of each arm is positioned at a distance from the post greater than one half foot.

14. The combination as recited in claim 13, wherein said distance from the post is at least as great as about three quarters of a foot.

15. The combination as recited in claim 12, wherein said arms and said stabilizing means are positioned so that the bottom portions of the arms are no greater than about one half foot below the ground surface.

16. A stabilizing apparatus, adapted to be positioned in a soil strata surrounding an upper part of a base portion of a post that is positioned in the ground strata, said apparatus comprising:

a) a central collar means having a center opening with a width dimension at least as great as a width dimension of the post;

b) a plurality of stabilizing arms positioned at angularly spaced locations around the collar means, each of said arms having a radially inward end portion connecting to the collar means and a radially outer portion extending radially outward from the collar means;

c) each of said arms having at the outer portion stabilizing wall means having a substantial allignment component transverse of the radial axis of its related arm; and d) said apparatus having radially inward means positioned to engage the post or be closely adjacent thereto in a manner to permit at least limited rotational movement of the post relative to a plane occupied by the apparatus, whereby lateral rotational movement of the post relative to the ground strata in which the apparatus is embedded is resisted with the apparatus exerting substantially lateral force components to resist such movement, and alleviate rotational force components that may otherwise be imparted from the post to the apparatus.

17. The apparatus as recited in claim 16, wherein the stabilizing wall is located at a distance greater than one half foot from a location at which a radially inward portion of the apparatus would engage the post.

18. The apparatus as recited in claim 16, wherein said each of said arms connects to the collar by releasable and adjustable connecting means, whereby the apparatus can be utilized to stabilize posts having different width dimensions.

19. The apparatus as recited in claim 17, wherein said distance is at least as great as three quarters of a foot.

20. The apparatus as recited in claim 16, wherein said apparatus comprises releasable connecting means by which said arms are releasedly connected to the collar means.

21. The apparatus as recited in claim 18, wherein said releasable connecting means comprises tongue and groove connecting means having a plurality of linearly spaced connecting positions so that said arms can be positioned at different radially spaced position.

22. The apparatus as recited in claim 20, wherein said arms and said collar means are arranged with complimentary graduated marking means, which indicate proper positioning of said arms for posts of various widths, so that said arm can be positioned in accordance with said complimentary marking means for the post in accordance with its width dimension.

23. The apparatus as recited in claim 16, wherein said arms are fixedly attached to said collar means.

24. The apparatus as recited in claim 16, further comprising an adapter configured to be positioned around said post and within said collar means to provide a bearing surface on said insert adapted to be in contact with, or closely adjacent to, said post.

25. The apparatus as recited in claim 16, wherein each arm has a second stabilizing wall positioned radially inwardly from said stabilizing wall means.

26. A method of installing a post into a ground strata, said method comprising:

a) providing in the ground strata a post hole having a post hole depth dimension;

b) inserting a lower end portion of the post into the post hole to position the post in an upstanding position;

c) excavating channels in an upper portion of the ground strata surrounding the post hole in a pattern where the channels extend outwardly from the post hole at regularly angularly spaced locations;

d) locating a central collar means having a center opening with a width dimension at least as great as a width dimension of said post around said post;

e) locating a plurality of stabilizing arms in said channels so as to be positioned at angularly spaced locations around the collar and selectively attaching each of the arms to the collar at a related one of a plurality of connecting locations so that with each of said arms has a radially inward end portion connecting to said collar with a radially inward end of each arm being sufficiently close to the post to resist a lateral force applied by the post to tilt the post laterally and a radially outer portion of the arm is extending outwardly from said collar means;

f) locating at an outer portion of each arm a stabilizing wall so that each wall has a substantial alignment component transverse to a lengthwise axis of its related arm;

g) filling the channels with a fill material to embed the arms and the walls in an upper portion of the ground strata.

27. The method as recited in claim 26, wherein said releasable connecting means comprises further comprising interconnecting a tongue and groove connection at a selected tongue and groove connecting location means having selected from a plurality of linearly spaced connecting locations positions.

28. The method as recited in claim 26, wherein said arms and said collar means are arranged with complimentary graduated marking means, which indicate proper positioning of said arms for posts of various widths, said method further comprising positioning said arms in accordance with said complimentary graduated marking means on the arms related to width dimensions of for the posts.

29. A stabilizing apparatus, adapted to be positioned in a soil strata surrounding an upper part of a base portion of a post that is positioned in the ground strata, said apparatus comprising:

a) central collar having a center opening with a width dimension at least as great as a width dimension of the post;

b) plurality of stablizing arms positioned at angularly spaced locations around the collar, each of said arms having a radially inward end portion connecting to the collar and a radially outer portion extending outward from the collar;

c) each of said arms having at the outer portion a stabilizing wall having a substantial alignment component transverse of the radial axis of its related arm;

d) said apparatus further comprising releasable connecting means by which said arms are releasedly connected to the collar, said releasable connecting means being arranged to be adjustably connect the related arms, so that the arms can be positioned by the connecting means so as to be in contact with, or closely adjacent to, said post, whereby said apparatus can be utilized to stabilize posts having different width dimensions.

30. The apparatus as recited in claim 29, wherein said releasable connecting means comprises tongue and groove connecting means having a plurality of linearly space connecting locations so that said arms can be positioned at different radially spaced position.

31. The apparatus as recited in claim 29, wherein said arms and said collar are arranged with complimentary graduated marking means, which indicate proper positioning of said arms for posts of various widths, whereby said arms can be positioned in accordance with said complimentary marking means for the posts in accordance with its width dimension.

* * * * *